US009488011B2

(12) United States Patent
Whittaker

(10) Patent No.: US 9,488,011 B2
(45) Date of Patent: Nov. 8, 2016

(54) SELECTIVELY LEACHED CUTTER

(75) Inventor: Malcolm E. Whittaker, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 353 days.

(21) Appl. No.: 14/110,589

(22) PCT Filed: Apr. 20, 2012

(86) PCT No.: PCT/US2012/034381
§ 371 (c)(1),
(2), (4) Date: Oct. 8, 2013

(87) PCT Pub. No.: WO2012/145586
PCT Pub. Date: Oct. 26, 2012

(65) Prior Publication Data

US 2014/0166371 A1 Jun. 19, 2014

(30) Foreign Application Priority Data

Apr. 20, 2011 (GB) ..... 1106765.9

(51) Int. Cl.
*E21B 10/573* (2006.01)
*B22F 7/08* (2006.01)
(Continued)

(52) U.S. Cl.
CPC ..... *E21B 10/573* (2013.01); *B22F 7/08* (2013.01); *B24D 3/10* (2013.01); *C22C 1/00* (2013.01); *C22C 19/07* (2013.01); *C22C 26/00* (2013.01); *C22C 29/08* (2013.01); *E21B 10/567* (2013.01);
(Continued)

(58) Field of Classification Search
CPC ..... E21B 10/567; E21B 10/5676; E21B 10/573; C22C 19/07; C22C 1/00; C22C 29/08; C22C 26/00; B22F 7/08; B22F 2005/001; B24D 3/10
See application file for complete search history.

(56) References Cited

U.S. PATENT DOCUMENTS

2008/0006448 A1 1/2008 Zhang et al.
2010/0012391 A1 1/2010 Shamburger
(Continued)

FOREIGN PATENT DOCUMENTS

KR 10-2007-0009717 1/2007
WO 2010/097783 9/2010

OTHER PUBLICATIONS

Chinese Office Action and Search Report issued in Patent Application 201280030095.0; 14 pages w/English translation, Feb. 4, 2015.
(Continued)

*Primary Examiner* — Yong-Suk (Philip) Ro
(74) *Attorney, Agent, or Firm* — Baker Botts L.L.P.

(57) ABSTRACT

The present disclosure provides a method of manufacturing a polycrystalline diamond (PCD) cutting element used as drill bit cutting elements (10). The method includes leaching a PCD body formed from diamond particles (202) using a binder-catalyzing material so as to remove substantially all of the binder-catalyzing material from portions of a cutting surface of the PCD body. A portion (24) of the cutting surface is identified as a cutting area which, in use of the cutting element to cut material, is heated by the cutting action of the cutting element. Leaching of the PCD body includes performing a relatively deep leach in the portion of the cutting surface identified as the cutting area and performing a relatively shallow leach in at least the portion (26) of the cutting surface surrounding the identified cutting area.

19 Claims, 17 Drawing Sheets

(51) Int. Cl.

| | |
|---|---|
| ***C22C 1/00*** | (2006.01) |
| ***C22C 19/07*** | (2006.01) |
| ***C22C 26/00*** | (2006.01) |
| ***C22C 29/08*** | (2006.01) |
| ***E21B 10/567*** | (2006.01) |
| ***B24D 3/10*** | (2006.01) |
| *B22F 5/00* | (2006.01) |

(52) U.S. Cl.
CPC ..... *E21B 10/5676* (2013.01); *B22F 2005/001* (2013.01)

(56) References Cited

U.S. PATENT DOCUMENTS

| | | | | |
|---|---|---|---|---|
| 2010/0236837 | A1 | 9/2010 | Achilles | |
| 2010/0266816 | A1* | 10/2010 | Eyre | C22C 26/00 428/157 |
| 2010/0281782 | A1* | 11/2010 | Keshavan | C04B 35/52 51/295 |
| 2010/0300765 | A1 | 12/2010 | Zhang et al. | |
| 2011/0023375 | A1 | 2/2011 | Sani et al. | |
| 2011/0036641 | A1 | 2/2011 | Lyons | |

OTHER PUBLICATIONS

Korean Office Action issued in Patent Application (PCT) 10-2013-7030815; 2 pages, Feb. 9, 2015.
International Search Report on Patentability; PCT/US2012/034381; pp. 9, Oct. 31, 2013.
International Search Report and Written Opinion, Application No. PCT/US2012/034381, 11 pages, Jul. 5, 2012.
Extended European Search Report issued in Application No. EP12774325; 7 pages, Jul. 7, 2015.
International Preliminary Report on Patentability, Application No. PCT/US2012/034381; 8 pages, Oct. 22, 2013.
Office Action, Canadian Application No. 2,832,988; 4 pages, Jul. 31, 2015.
Office Action, Korean Application No. 10-2013-7030815; with English translation; 14 pages, Aug. 27, 2015.
Office Action, Canadian Application No. 2,832,988; 4 pages, Apr. 22, 2016.
Office Action, Chinese Application No. 201280030095.0, with English translation; 10 pages, Jun. 2, 2016.
Office Action, Korean Application No. 10-2013-7030815, with English translation; 6 pages, Jul. 25, 2016.

* cited by examiner

SELECTIVELY LEACHED CUTTER

CROSS-REFERENCE TO RELATED APPLICATION

This application is a U.S. National Stage Application of International Application No. PCT/US2012/034381 filed Apr. 20, 2012, which designates the United States and claims the benefit of British Patent Application Serial No. 1106765.9, filed on Apr. 20, 2011, the entire disclosures of which are hereby incorporated by reference.

FIELD OF THE INVENTION

The present invention relates to polycrystalline diamond cutting elements, and to methods for leaching and methods for manufacturing the same.

TECHNICAL BACKGROUND

Polycrystalline diamond and polycrystalline diamond-like elements are known, for the purposes of this specification, as PCD elements. PCD elements are formed from carbon based materials with exceptionally short inter-atomic distances between neighbouring atoms. One type of diamond-like material similar to PCD is known as carbonitride (CN) described in U.S. Pat. No. 5,776,615. In general, PCD elements are formed from a mix of materials processed under high-temperature and high-pressure into a polycrystalline matrix of inter-bonded superhard carbon based crystals. A common trait of PCD elements is the use of catalyzing materials during their formation, the residue from which often imposes a limit upon the maximum useful operating temperature of the element while in service.

A well known, manufactured form of PCD element is a two-layer or multi-layer PCD element where a facing table of polycrystalline diamond is integrally bonded to a substrate of less hard material, such as tungsten carbide. The PCD element may be in the form of a circular or part-circular tablet, or may be formed into other shapes. PCD elements of this type may be used in almost any application where a hard, wear- and erosion-resistant material is required. The substrate of the PCD element may be brazed to a carrier, often also of cemented tungsten carbide. This is a common configuration for PCDs used as cutting elements, for example in fixed cutter or rolling cutter earth boring bits when, received in a socket of the drill bit. These PCD elements are typically called polycrystalline diamond cutters (PDC).

Typically, higher diamond volume densities in the diamond table increases wear resistance at the expense of impact strength. However, modern PDCs typically utilize complex geometrical interfaces between the diamond table and the substrate as well as other physical design configurations to improve the impact strength. Although this allows wear resistance and impact strength to be simultaneously maximized, the trade-off still exists.

Another form of PCD element is a unitary PCD element without an integral substrate, where a table of polycrystalline diamond is fixed to a tool or wear surface by mechanical means or a bonding process. These PCD elements differ from those above in that diamond particles are present throughout the element. These PCD elements may be held in place mechanically, they may be embedded within a larger PCD element that has a substrate, or, alternately, they may be fabricated with a metallic layer which may be bonded by a brazing or welding process. A plurality of these PCD elements may be made from a single PCD, as shown, for example, in U.S. Pat. Nos. 4,481,016 and 4,525,179 herein incorporated by reference for all they disclose.

PCD elements are most often formed by sintering diamond powder with a suitable binder-catalyzing material in a high-pressure, high-temperature (HPHT) press. One particular method of forming polycrystalline diamond in this way is disclosed in U.S. Pat. No. 3,141,746 herein incorporated by reference for all it discloses. In one common process for manufacturing PCD elements, diamond powder is applied to the surface of a preformed tungsten carbide substrate incorporating cobalt. The assembly is then subjected to very high temperature and pressure in a press. During this process, cobalt migrates from the substrate into the diamond layer and acts as a binder-catalyzing material, causing the diamond particles to bond to one another with diamond-to-diamond bonding, and also causing the diamond layer to bond to the substrate.

The completed PCD element has at least one body with a matrix of diamond crystals bonded to each other with intercrystalline bonds and defining many interstices between the crystals which contain a binder-catalyzing material as described above. The diamond crystals comprise a first continuous matrix of diamond, and the interstices form a second continuous interstitial matrix of the binder-catalyzing material. In addition, there are necessarily a relatively few areas where the diamond to diamond growth has encapsulated some of the binder-catalyzing material. These 'islands' are not part of the continuous interstitial matrix of binder-catalyzing material.

Such PCD elements may be subject to thermal degradation due to differential thermal expansion between the interstitial cobalt binder-catalyzing material and the diamond matrix, beginning at temperatures of about 400 degrees C. Upon sufficient thermal expansion, the diamond-to-diamond bonding may be ruptured and cracks and chips may occur. The differential of thermal expansion may also be referred to as the differential of co-efficient of thermal expansion.

Also in polycrystalline diamond, the presence of the binder-catalyzing material in the interstitial regions adhering to the diamond crystals of the diamond matrix leads to another form of thermal degradation. Due to the presence of the binder-catalyzing material, the diamond is caused to graphitize as temperature increases, typically limiting the operation temperature to about 750 degrees C.

Although cobalt is most commonly used as the binder-catalyzing material, any group VIII element, including cobalt, nickel, iron, and alloys thereof, may be employed.

To reduce thermal degradation, so-called "thermally stable" polycrystalline diamond components have been produced as preform PCD elements for cutting- and/or wear-resistant elements, as disclosed in U.S. Pat. No. 4,224,380 herein incorporated by reference for all it discloses. In one type of thermally stable PCD element the cobalt or other binder-catalyzing material found in a conventional polycrystalline diamond element is leached out from the continuous interstitial matrix after formation. Numerous methods for leaching the binder-catalyzing material are known. Some leaching methods are disclosed, for example, in U.S. Pat. Nos. 4,572,722 and 4,797,241 both herein incorporated by reference for all they disclose.

Leaching the binder-catalyzing material may increase the temperature resistance of the diamond to about 1200 degrees C. However, the leaching process also has a tendency to remove the cemented carbide substrate. In addition, where there is no integral substrate or other bondable surface, there are severe difficulties in mounting such material for use in operation. There is some belief that it is advisable to not leach closer to the substrate than 500 microns.

The fabrication methods for such 'thermally stable' PCD elements typically produce relatively low diamond volume densities, typically of the order of 80 volume % or less. This low diamond volume density enables a thorough leaching process, but the resulting furnished part is typically relatively weak in impact strength. The low volume density is typically achieved by using an admixtures process and using relatively small diamond crystals with average particle sizes of about 15 microns or less. These small particles are typically coated with a catalyzing material prior to processing. The admixtures process causes the diamond particles to be widely spaced in the finished product and relatively small percentages of their outer surface areas dedicated to diamond-to-diamond bonding, often less than 50%, contributing to the low impact strengths.

In these so-called "thermally stable" polycrystalline diamond components, the lack of a suitable bondable substrate for later attachment to a work tool has been addressed by several methods. One such method to attach a bondable substrate to a "thermally stable" polycrystalline diamond preform is shown in U.S. Pat. No. 4,944,772 herein incorporated by reference for all it discloses. In this process, a porous polycrystalline diamond preform is first manufactured, and then it is re-sintered in the presence of a catalyzing material at high-temperatures and pressures with a barrier layer of another material which, in theory, prevents the catalyzing material from re-infiltrating the porous polycrystalline diamond preform. The resulting product typically has an abrupt transition between the preform and the barrier layer, causing problematic stress concentrations in service. This product is considered to be more like a joined composite than an integral body.

Other, similar processes to attach a bondable substrate to "thermally stable" polycrystalline diamond components are shown in U.S. Pat. Nos. 4,871,377 and 5,127,923 herein incorporated by reference for all they disclose. It is believed that the weakness of all these processes is the degradation of the diamond-to-diamond bonds in the polycrystalline diamond preform from the high temperature and pressure re-sintering process. It is felt that this degradation generally further reduces the impact strength of the finished product to an unacceptably low level below that of the preform.

In an alternative form of thermally stable polycrystalline diamond, silicon is used as the catalyzing material. The process for making polycrystalline diamond with a silicon catalyzing material is quite similar to that described above, except that, at synthesis temperatures and pressures, most of the silicon is reacted to form silicon carbide, which is not an effective catalyzing material. The thermal resistance is somewhat improved, but thermal degradation still occurs due to some residual silicon remaining, generally uniformly distributed in the interstices of the interstitial matrix. Again, there are mounting problems with this type of PCD element because there is no bondable surface.

More recently, a further type of PCD has become available in which carbonates, such as powdery carbonates of Mg, Ca, Sr, and Ba are used as the binder-catalyzing material when sintering the diamond powder. PCD of this type typically has greater wear-resistance and hardness than the previous types of PCD elements. However, the material is difficult to produce on a commercial scale since much higher pressures are required for sintering than is the case with conventional and thermally stable polycrystalline diamond. One result of this is that the bodies of polycrystalline diamond produced by this method are smaller than conventional polycrystalline diamond elements. Again, thermal degradation may still occur due to the residual binder-catalyzing material remaining in the interstices. Again, because there is no integral substrate or other bondable surface, there are difficulties in mounting this material to a working surface.

In some known techniques, physical vapor deposition (PVD) and/or chemical vapor deposition (CVD) processes are used to apply the diamond or diamond-like coating. PVD and CVD diamond coating processes are well known and are described, for example, in U.S. Pat. Nos. 5,439,492; 4,707,384; 4,645,977; 4,504,519; 4,486,286 all herein incorporated by reference.

PVD and/or CVD processes to coat surfaces with diamond or diamond like coatings may be used, for example, to provide a closely packed set of epitaxially oriented crystals of diamond or other superhard crystals on a surface. Although these materials have very high diamond densities because they are so closely packed, there is no significant amount of diamond to diamond bonding between adjacent crystals, making them quite weak overall, and subject to fracture when high shear loads are applied. The result is that although these coatings have very high diamond densities, they tend to be mechanically weak, causing very poor impact toughness and abrasion resistance when, used in highly loaded applications, such as when used as drill bit cutting elements.

Some attempts have been made to improve the toughness and wear resistance of these diamond or diamond-like coatings by applying them to a tungsten carbide substrate and subsequently processing them in a high-pressure, high-temperature environment, as described in U.S. Pat. Nos. 5,264,283; 5,496,638; 5,624,068, which are herein incorporated by reference for all they disclose. Although this type of processing may improve the wear resistance of the diamond layer, the abrupt transition between the high-density diamond layer and the substrate make the diamond layer susceptible to wholesale fracture at the interface at very low strains, similar to the above described problems encountered with composite structures having barrier layers. This again translates to very poor toughness and impact resistance in service.

U.S. Pat. No. 6,601,662 discloses PCD cutting elements which are adapted to control the wear profile of the cutting or working faces to increase the operating life of the cutting elements, primarily by making the elements self-sharpening so that a greater proportion of the cutter body can be worn away and used in effectively cutting material.

The cutting elements have one portion of the working surface which is treated to leach substantially all catalyst material from the interstices near the working surface of the PCD element in an acid etching process to a depth of greater than about 0.2 mm, in order to increase the wear resistance of the cutting elements. In particular, this provides a superhard polycrystalline diamond or diamond-like element with greatly improved wear resistance without loss of impact strength.

Each cutting element also has another surface which is not treated, such that some catalyzing material remains in the interstices, or, alternatively, the another surface is only partially treated, or at least less treated than the one portion of the working surface. In one embodiment, a gradual (continuous) change in the treatment is indicated. In this way, the treated, more wear-resistant portions cause the element to be self-sharpening.

Further disclosed arrangements include a treated surface and a surface which is not treated such that some catalyzing material remains in the interstices, and further include another surface which is only partially treated, or at least less treated than the treated surface.

Different arrangements of varied wear resistance on the front and side working surfaces of PCD cutting elements are also disclosed. Again, each has a treated surface and a surface which is not treated such that some catalyzing material remains in the interstices. The disclosed elements have two working surfaces (e.g. the PCD body end face and side wall) such that the varied wear resistance may be applied to either or both surfaces. Another surface which is only partially treated, or at least less treated than the treated surface, may also be included in place of portions of the untreated surface.

U.S. Pat. Nos. 5,517,589; 7,608,333; 7,740,673; and 7,754,333, and U.S. patent application Ser. Nos. 11/776,389 and 12/820,518, disclose various thermally stable diamond polycrystalline diamond constructions.

U.S. Pat. No. 5,120,327, issued to Diamant-Boart Stratabit (USA), Inc. and assigned to Halliburton Energy Services, Inc., discloses an carbide substrate and a diamond layer adhered to a surface of the substrate. That surface includes a plurality of spaced apart ridges forming grooves therebetween.

SUMMARY OF THE INVENTION

According to a first aspect of the present invention, there is provided a method of manufacturing a polycrystalline diamond (PCD) cutting element comprising: leaching a PCD body formed from diamond particles using a binder-catalyzing material so as to remove substantially all of the binder-catalyzing material from portions of a cutting surface of the PCD body, wherein the method involves identifying a portion of the cutting surface as a cutting area which, in use of the cutting element to cut material, is heated by the cutting action of the cutting element, and wherein leaching the PCD body includes performing a relatively deep leach in the portion of the cutting surface identified as the cutting area and performing a relatively shallow leach in at least the portion of the cutting surface surrounding the identified cutting area.

In embodiments of the invention, the portion of the cutting surface surrounding the identified cutting area is masked whilst performing the relatively deep leach.

In these or other embodiments of the invention, the relatively deep leach is performed before performing the relatively shallow leach.

In these or other embodiments of the invention, the relatively shallow leach is applied to substantially all of the cutting surface of the PCD body.

In these or other embodiments of the invention, substantially no leaching is performed at a central portion of the cutting surface.

In these or other embodiments of the invention, performing the relatively shallow leach includes performing the relatively shallow leach on a side surface of the PCD body which extends from the cutting surface.

In these or other embodiments of the invention, the PCD body is substantially cylindrical and the cutting surface is one of the end faces of the cylinder, and wherein the identified cutting area includes at least a portion of a cutting edge that extends around the cutting surface, between the cutting surface and the cylindrical side wall. Here, the cutting edge may be a chamfered edge between the cutting surface and the side wall.

In these or other embodiments of the invention, identifying a cutting area which, in use of the cutting element to cut material, is heated by the cutting action of the cutting element, includes identifying multiple areas which independently act as the cutting area in dependence on the orientation of the PCD cutting element in use; and leaching the PCD body includes performing a relatively deep leach in each of the multiple areas of the cutting surface identified as the cutting areas and performing a relatively shallow leach in at least the portions of the cutting surface surrounding each identified cutting area. Here, performing a relatively deep leach may include simultaneously leaching all of the multiple portions of the cutting surface identified as the cutting areas. Also, two or three or more of the multiple areas may be substantially identical and disposed with rotational symmetry about an axis of the PCD body, such that, in use of the cutting element held in a cutting tool, the PCD body can be rotated about the axis after a first of the two or three or more areas has independently acted as a cutting area and become worn down, so as to bring the worn first cutting area out of cutting orientation and to bring another of the two or three or more areas into the cutting orientation.

In these or other embodiments of the invention, the cutting element includes one or more indicia to indicate the position of the identified cutting area.

In these or other embodiments of the invention, the identified cutting area includes substantially all of the cutting edge, which extends substantially entirely around the cutting surface.

In these or other embodiments of the invention, leaching further involves performing leaching to different depths in a transition region between the portions being relatively deep-leached and the portions being relatively shallow-leached, to obtain a desired leaching-depth profile.

According to a second aspect of the present invention, there is provided a method of manufacturing a polycrystalline diamond (PCD) cutting element from a PCD body comprising a diamond matrix of intercrystalline bonded diamond particles, defining interstitial regions containing a binder-catalyzing material therein, the method comprising: removing substantially all binder-catalyzing material from a first surface region of the diamond matrix to a depth of not less than about 0.15 mm; and removing substantially all binder-catalyzing material from a second surface region of the diamond matrix that surrounds the first surface region to a depth of not less than about 0.01 mm and not more than about 0.12 mm, wherein the first surface region includes at least a portion of a cutting edge that extends around at least a portion of a cutting face of the PCD body.

In embodiments of the invention, removing substantially all binder-catalyzing material from the first surface region of the diamond matrix includes removing substantially all binder-catalyzing material to a depth of not less than about 0.18 mm, or not less than about 0.2 mm, or not less than about 0.22 mm.

In these or other embodiments of the invention, removing substantially all binder-catalyzing material from the second surface region of the diamond matrix includes removing substantially all binder-catalyzing material to a depth of not less than about 0.02 mm or not less than about 0.03 mm.

In these or other embodiments of the invention, removing substantially all binder-catalyzing material from the second surface region of the diamond matrix includes removing substantially all binder-catalyzing material to a depth of not more than about 0.1 mm, or not more than about 0.08 mm, or not more than about 0.05 mm.

In these or other embodiments of the invention, the binder-catalyzing material is removed by leaching, and wherein the second surface region of the diamond matrix is masked at a time when the first surface region is being leached.

In these or other embodiments of the invention, the second surface region includes at least a portion of a side surface of the PCD body, which side surface extends from the cutting face and meets the cutting face at the cutting edge. Here, the first surface region may include a portion of the side surface of the PCD body.

In these or other embodiments of the invention, the cutting edge is chamfered.

In these or other embodiments of the invention, the first surface region includes at least two or at least three separate regions which include respective portions of cutting edges extending respectively around at least two or at least three separate portions of the cutting face. Here, the cutting element may include one or more indicia to indicate the positions of the separate regions. Also, the separate regions may be substantially identical and disposed with rotational symmetry about an axis of the PCD body.

In these or other embodiments of the invention, the first surface region includes a cutting edge which extends substantially entirely around the cutting face.

In these or other embodiments of the invention, the PCD body is substantially cylindrical and the cutting face is one of the end faces of the cylinder.

In these or other embodiments of the invention, the second surface region includes substantially all of the cutting face apart from the first surface region.

In these or other embodiments of the invention, the second surface region does not include a central area of the cutting face.

According to a third aspect of the present invention, there is provided a drill bit comprising a cutting element manufactured in accordance with the first and/or second aspect of the invention.

According to a fourth aspect of the present invention, there is provided a polycrystalline diamond (PCD) cutting element comprising: a PCD body exhibiting a cutting face and defining a cutting edge around at least a portion of the cutting face, wherein the PCD body comprises a diamond matrix of intercrystalline bonded diamond particles defining interstitial regions containing a binder-catalyzing material, wherein a first region at the surface of the diamond matrix comprises substantially no binder-catalyzing material to a depth of not less than about 0.15 mm, said first region including at least a portion of said cutting edge, and wherein a second region at the surface of the diamond matrix surrounding said first region contains substantially no binder-catalyzing material to a depth of not less than about 0.01 mm and not more than about 0.12 mm.

In an embodiment of the invention, the first region at the surface of the diamond matrix comprises substantially no binder-catalyzing material to a depth of not less than about 0.18 mm, or not less than about 0.2 mm, or not less than about 0.22 mm.

In these or other embodiments of the invention, the second region at the surface of the diamond matrix contains substantially no binder-catalyzing material to a depth of not less than about 0.02 mm, or not less than about 0.03 mm.

In these or other embodiments of the invention, the second region at the surface of the diamond matrix contains substantially no binder-catalyzing material to a depth of not more than about 0.1 mm, or not more than about 0.08 mm, or not more than about 0.05 mm.

In these or other embodiments of the invention, the second region at the surface of the diamond matrix includes at least a portion of a side surface of the PCD body, which side surface extends from the cutting face and meets the cutting face at the cutting edge. Here, the first region at the surface of the diamond matrix includes a portion of the side surface of the PCD body.

In these or other embodiments of the invention, the cutting edge is chamfered.

In these or other embodiments of the invention, the first region at the surface of the diamond matrix includes at least two or at least three separate regions which include respective portions of cutting edges extending respectively around at least two or at least three separate portions of the cutting face. Here, the cutting element may include one or more indicia to indicate the positions of the separate regions. Also, the separate regions may be substantially identical and disposed with rotational symmetry about an axis of the PCD body.

In these or other embodiments of the invention, the first surface region includes a cutting edge which extends substantially entirely around the cutting face.

In these or other embodiments of the invention, the PCD body is substantially cylindrical and the cutting face is one of the end faces of the cylinder.

In these or other embodiments of the invention, the second region at the surface of the diamond matrix includes substantially all of the cutting face apart from the first region at the surface of the diamond matrix.

In these or other embodiments of the invention, the second region at the surface of the diamond matrix does not include a central area of the cutting face.

In these or other embodiments of the invention, a transition region exists between the first region at the surface of the diamond matrix and the second region at the surface of the diamond matrix, in which the depth to which substantially no binder-catalyzing material is contained substantially continuously varies according to a thermal stability depth profile.

According to a fifth aspect of the present invention, there is provided a method of leaching a polycrystalline diamond (PCD) body comprising: determining an operating temperature expected to be encountered at a working portion of a working surface of the PCD body; determining an isotherm for the temperature experienced in the PCD body if unleached and under application of the operating temperature at the working portion, wherein the isotherm is indicative of the depth to which a temperature will persist at which an unleached PCD body will experience thermal degradation; and setting a leaching profile for the PCD body which substantially corresponds to the isotherm in the region of the working portion.

An embodiment of the present invention further comprises: determining an updated isotherm for the temperature experienced in the PCD body if leached according to the set leaching profile and under application of the operating temperature at the working portion, wherein the isotherm is indicative of the depth to which the temperature, will persist at which unleached portions of the PCD body will experience thermal degradation; and adjusting the leaching profile by identifying differences between the updated isotherm and the set leaching profile, and adjusting the set leaching profile to reduce the leached depth in portions of the leaching profile deeper than the isotherm, whilst eliminating regions where the isotherm indicates that thermal degradation is likely to occur.

In these or other embodiments of the invention, adjusting the leaching profile includes adjusting the leaching depth in portions of the working surface other than the working portion so as to adjust the thermal conduction of heat through the PCD body and away from the working portion.

In these or other embodiments of the invention, the steps of determining an updated isotherm and adjusting the leaching profile are iteratively repeated for the adjusted leaching profile in place of the set leaching profile to minimise the leaching depth throughout the leaching profile whilst eliminating regions where thermal degradation is likely to occur.

In these or other embodiments of the invention, determining an operating temperature expected to be encountered at the working portion of the working surface of the PCD body includes simulating a drilling operation using a drill bit in which the PCD body is employed as a cutting element of the drill bit.

In alternative such embodiments according to the invention, determining an isotherm for the temperature experienced in the PCD body if unleached and under application of the operating temperature at the working portion further includes determining the isotherm for the PCD body in a partially-worn state in which material has been worn away at the working portion of the working surface of the PCD body relative to an unworn PCD body; and setting a leaching profile for the PCD body which substantially corresponds to the isotherm in the region of the working portion includes setting a leaching profile for the unworn PCD body based on the isotherm determined for a PCD body in the partially-worn state.

In these or other embodiments of the invention, the leaching profile for the PCD body is further set in dependence on the rake angle of the cutting element on the drill bit.

According to a sixth aspect of the present invention, there is provided a drill bit comprising a PCD body leached in accordance with the fifth aspect of the present invention.

According to a seventh aspect of the present invention, there is provided a polycrystalline diamond (PCD) cutting element having distinct leached cutting areas at two or three or more separate locations provided offset from an axis of the cutting element so as to be rotationally displaced from one another around said axis such that, by adjusting the rotational orientation of the cutting element about the axis when fixing the cutting element to a cutting tool, each of the two or three or more cutting areas can independently be brought into a cutting position in which they perform cutting during use of the cutting tool.

An embodiment of the present invention further comprises one or more indicia indicative of the positions of the two or three or more cutting areas.

In these or other embodiments of the invention, the cutting areas can be used successively in turn for cutting by adjusting the rotational orientation of the cutting element in the cutter after use, so as to replace a worn cutting area of the cutting element by an unworn cutting area at the cutting position.

In these or other embodiments of the invention, the leached cutting areas each include a portion of an edge of a cutting face of the PCD cutting element. Here, the respective portions are portions of edges or the edge of the same cutting face.

According to an eighth aspect of the present invention, there is provided a polycrystalline diamond (PCD) cutting element having a cutting face at an end thereof, the cutting face defining an edge extending substantially entirely around the cutting face, wherein one or more portions of the edge are leached to form a cutting edge and wherein the centre of the cutting face is unleached.

In an embodiment of the present invention, substantially the entire edge around the cutting face is leached to form a cutting edge.

In these or other embodiments of the invention, the edge is chamfered.

In these or other embodiments of the invention, the leaching extends onto at least a portion of a side wall of the cutting element.

In these or other embodiments of the invention, the cutting element is substantially cylindrical. Here, the cutting element is substantially circular in cross-section.

In these or other embodiments of the invention, the PCD element includes a matrix of intercrystalline bonded diamond particles defining interstitial regions containing a binder-catalyzing material therein, and wherein substantially all binder-catalyzing material has been removed to a predetermined depth from leached parts of the matrix.

According to a ninth aspect of the present invention, there is provided a method of manufacturing a polycrystalline diamond (PCD) cutting element comprising: masking substantially all of the cutting element except for cutting areas at two or three or more separate locations provided offset form an axis of the cutting element so as to be rotationally displaced from one another around said axis; and leaching the masked cutting element to leach the cutting areas.

According to a tenth aspect of the present invention, there is provided a method of manufacturing a polycrystalline diamond (PCD) cutting element having a cutting face at an end thereof, the cutting face defining an edge extending substantially entirely around the cutting face, the method comprising: masking at least a central portion of the cutting face; and leaching the masked cutting element to leach one or more portions of the edge to form a cutting edge or cutting edges, with the centre of the cutting face masked from being leached.

In embodiments of the ninth or tenth aspect of the invention, the PCD cutting element is unleached prior to masking.

These or other embodiments of the ninth and tenth aspects of the invention further comprise removing the mask and again leaching the PCD cutting element. Here, the method may further include, after the mask is removed and prior to again leaching the PCD cutting element, masking the PCD cutting element again with a different masking pattern.

In these or other embodiments of the ninth and tenth aspects of the invention, the method includes leaching the PCD cutting element a total of 3 or more times, with a different masking pattern being applied to mask or expose one or more different portions of the PCD cutting element each time, wherein one of the masking patterns may comprise applying substantially no masking to the surface of the diamond matrix of the PCD cutting element.

BRIEF DESCRIPTION OF THE DRAWINGS

To enable a better understanding of the present invention, and to show how the same may be carried into effect, reference will now be made, by way of example only, to the accompanying drawings, in which:—

DETAILED DESCRIPTION

Figure 1:
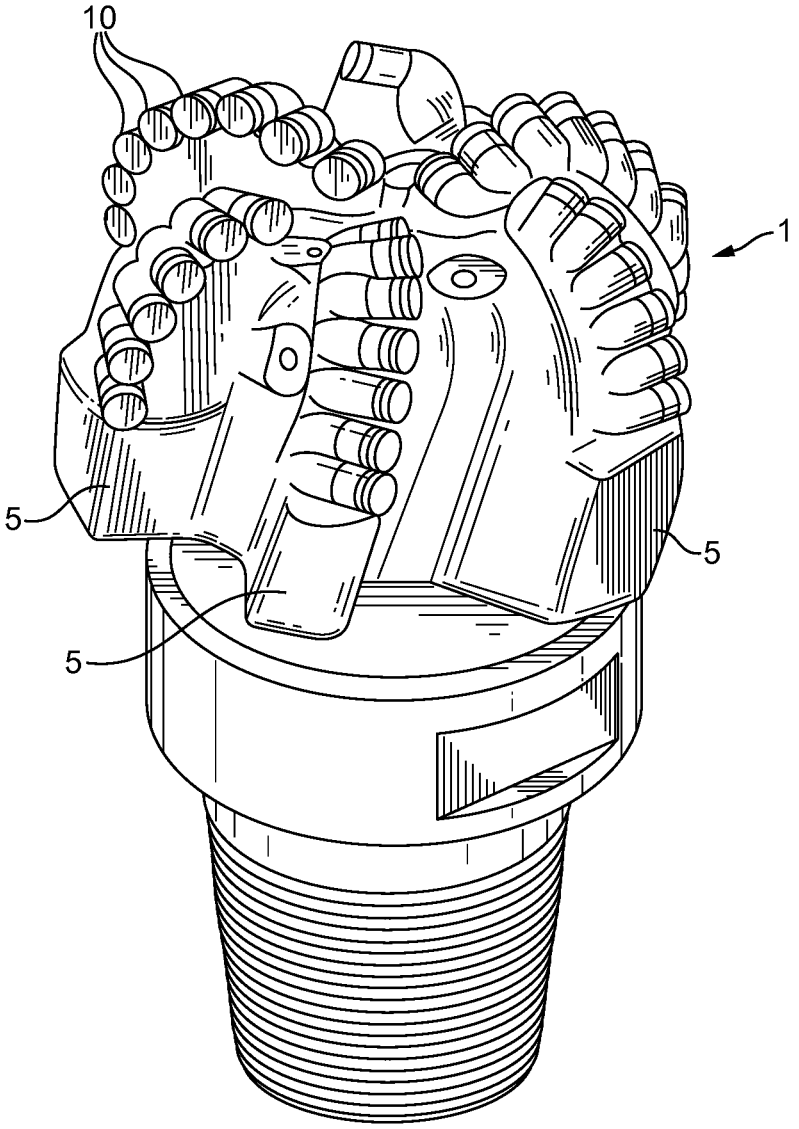
FIG. 1 shows a three-dimensional perspective view of a fixed blade rotary drill bit having PCD cutting elements mounted to the cutting blades.

Before referring specifically to the drawings, some general characteristics of PCD elements and PCD cutting elements (also called polycrystalline diamond cutters, or PDCs) should be noted.

Polycrystalline diamond and polycrystalline diamond-like elements are collectively called PCD elements for the purposes of this specification. These elements are formed with a binder-catalyzing material in a high-temperature, high-pressure (HTHP) process. The PCD element has a plurality of partially bonded diamond or diamond-like crystals forming a continuous diamond matrix table or body. It is the binder-catalyzing material that allows the intercrystalline bonds to be formed between adjacent diamond crystals at the relatively low pressures and temperatures obtainable in a press suitable for commercial production.

The diamond matrix body may have a diamond volume density greater than 85%. During the process, interstices among the diamond crystals form into a continuous interstitial matrix containing the binder-catalyzing material. The diamond matrix body has a working surface, which for polycrystalline diamond cutting elements (also known as polycrystalline diamond cutters, or PDCs) is also known as the cutting surface. One or more portions of the interstitial matrix in the PCD body adjacent to and extending from the working surface are substantially free of the catalyzing material, and the remaining interstitial matrix contains the catalyzing material.

Because the portion of the PCD body adjacent to the working surface is substantially free of the binder-catalyzing material, the deleterious effects of the binder-catalyzing material are substantially decreased, and thermal degradation of the working surface due to the presence of the catalyzing material can be effectively eliminated. The result is a PCD element that is resistive to thermal degradation for surface generated temperatures above 750 degrees C., up to about 1200 degrees C., while maintaining the toughness, convenience of manufacture, and bonding ability of PDC elements containing the binder-catalyzing material throughout the interstitial matrix. This translates to higher wear resistance in cutting applications. These benefits can be gained without loss of impact strength in the elements.

The diamond matrix table (PCD body) is preferably integrally bonded to a substrate containing the binder-catalyzing material during the HTHP process. Preferably, the layer of interstitial regions where the PCD body contacts the substrate contains binder-catalyzing material and has an average thickness greater than 0.15 mm, in order to secure the diamond matrix table to the substrate.

The substrate is preferably of less hard material than the PCD body, usually cemented tungsten carbide or another metallic material, but use of a substrate is not required.

Typically, a PCD cutting element has a body in the form of a circular tablet having a thin front facing table presenting a cutting face of diamond or diamond-like (PCD) material, bonded in a high-pressure high-temperature press to a substrate of less hard material such as cemented tungsten carbide or other metallic material. The PCD cutting element is typically preformed and then bonded onto a generally cylindrical carrier which is also formed from cemented tungsten carbide.

In application to a fixed blade rotary drill bit, the cylindrical carrier is received within a correspondingly shaped socket or recess in the blade. The carrier will usually be brazed or shrink-fitted into the socket.

In general, the average diamond volume density in the body of the PCD element should range from about 85% to about 99%. Average diamond volume density may also be referred to as the diamond fraction by volume. The high diamond volume density can be achieved by using diamond crystals with a range of particle sizes, with an average particle size ranging from about 15 to about 60 microns, with the preferred range on the order of 15-25 microns. Typically, the diamond mixture may comprise 1% to 60% diamond crystals in the about 1-15 micron range, 20% to 40% diamond crystals in the 25-40 micron range, and 20% to 40% diamond crystals in the 50-80 micron diameter range, although numerous other size ranges and percentages may be use. A mixture of large and small diamond crystals may allow the diamond crystals to have relatively high percentages of their outer surface areas dedicated to diamond-to-diamond bonding, often approaching 95%, contributing to a relatively high apparent abrasion resistance.

There are many methods for removing or depleting the catalyzing material from the interstices. In one common example, the catalyzing material is cobalt or another iron group material (Group VIII metal), and the method of removing the catalyzing material is to leach it from the interstices near the working surface of the PCD element in an acid etching process. It is also possible that the method of removing the catalyzing material from near the surface may be by electrical discharge, or another electrical or galvanic process, or by evaporation.

As previously described, there are two modes of thermal degradation of the PCD today known to be caused by the catalyzing material. The first mode of thermal degradation begins at temperatures as low as about 400 degrees C. and is due to differential thermal expansion between the binder-catalyzing material in the interstitial matrix and the crystals in the intercrystalline bonded diamond matrix. Upon sufficient heating, the attendant differential expansion may cause the diamond-to-diamond bonding to rupture, such that cracks and chips may occur.

The second mode of thermal degradation begins at temperatures of about 750 degrees C. This mode is caused by the catalyzing ability of the binder-catalyzing material contacting the diamond crystals causing the crystals to graphitize as the temperature exceeds about 750 degrees C. As the crystals graphitize, they undergo a phase change accompanied by a large volume increase, which may result in the PCD body cracking and dis-bonding from the substrate. Even a coating of a few microns of the catalyzing material on the surfaces of the diamond crystals can cause this mode of thermal degradation to occur.

It will therefore be appreciated that, for maximum benefit, the catalyzing material must be removed both from the interstices among the diamond crystals and from the surfaces of the diamond crystals as well. If the catalyzing material is removed from both the surfaces of the diamond crystals and from the interstices between them, the onset of thermal degradation for the diamond crystals in that region should not occur until approaching 1200 degrees C.

It should be apparent that it is more difficult to remove the catalyzing material from the surfaces of the diamond crystals than from the interstice. For this reason, depending upon the manner in which the catalyzing material is depleted, to be effective in reducing thermal degradation, the depth of depletion of the catalyzing material from the working surface may vary depending upon the method used for depleting the catalyzing material.

Indeed, in some applications, improvement of the thermal threshold to above 400 degrees C. but less than 750 degrees C. is adequate, and therefore a less intense catalyzing material depletion process is permissible. As a consequence, it will be appreciated that there are numerous combinations of catalyzing material depletion methods which could be applied to achieve the level of catalyzing material depletion required for a specific application.

In this specification, when the term "substantially free" is used to refer to binder-catalyzing material having been removed from the interstices, the interstitial matrix, or a volume of the PCD body, it should be understood that many, if not all, the surfaces of the adjacent crystals in the intercrystalline bonded diamond matrix may still have a coating of the binder-catalyzing material.

To be effective, the binder-catalyzing material has to be removed at the point of heat generation at the working surface to a depth sufficient to allow the temperature in the regions of the PCD body where the catalyzing material is present to be kept below the local thermal degradation temperature. Improved thermal degradation resistance improves wear rates because the thermally stable intercrystalline bonded diamond matrix is able to retain its structural integrity and so its mechanical strength.

Diamond is known as a thermal conductor. If a friction event at the working surface causes a sudden, extreme heat input, the bonded diamond crystals will conduct the heat in all directions away from the event. This can permit an extremely high temperature gradient to be obtained through the intercrystalline bonded diamond material, for example of up to 1000 degrees C. per mm, or higher. Of course, the actual temperature gradient experienced will vary depending upon the diamond crystal size and the amount of intercrystal bonding. However, it is unclear if such a large thermal gradient actually exists.

One particularly useful application for the PCD elements herein disclosed is as cutting elements, or PDCs (polycrystalline diamond cutters). The working surface of the PCD cutting elements may be a top working surface (endface) and/or a peripheral working surface. The PCD cutting elements shown in the accompanying drawings are ones that may typically be used in fixed cutter type rotary drill bits. Although not illustrated, another type of PCD cutting element is shaped as a dome. This type of PCD cutting element can have an extended base for insertion into sockets in a rolling cutter drill bit or in the bodies of either fixed-cutter or rolling-cone types of rotary drill bits.

Taking into account the foregoing general technical considerations and details relating to PCD elements, a more specific description will now be made, in particular with reference to the accompanying drawings, in which embodiments of the present invention are shown, as well as examples useful for understanding the invention.

It should be appreciated that the drawings are principally schematic in nature, intended to convey the underlying technology of the invention without necessarily expressing the relative sizes, shapes and dimensions of the components illustrated. In particular, certain features may be shown enlarged or exaggerated relative to other features, merely for illustrative purposes.

Where reference is made herein to the depth to which a PCD element has been leached in any portion, region or area, the depth shall be taken to be the distance from the boundary between the leached and unleached portions within the PCD element to the nearest surface of the PCD element from which the leaching took place. In the majority of cases, this will correspond to the perpendicular depth as measured from the surface from which leaching took place.

As explained above, the process of leaching can lead to the leached portion of the intercrystalline bonded diamond matrix becoming brittle, and so less impact resistant. There therefore remains a trade off between the gains in thermal stability achieved by, leaching to a greater depth, and the attendant loss of toughness and impact resistance associated with this.

At the same time, the time, effort and attendant cost associated with the manufacture of the PCD cutting elements has to be weighed against any obtainable effective increase in performance, not only in terms of the performance of the PCD cutting element itself in terms of wear resistance and impact strength but also in terms of the performance of the drilling bit in which the PCD cutting element is contained.

To date, commercially available PCD cutting elements are manufactured almost exclusively by performing a uniform leaching process to the entire outer surface of the PCD body of the cutting element. As such, the existing technology still struggles with the act of balancing between the impact strength and wear resistance or thermal integrity of the PCD cutting element.

A driving factor has therefore been to reduce any trade off in impact strength by minimizing the amount of depletion of the binder-catalyzing material from the interstitial regions in the intercrystalline bonded diamond matrix of the PCD bodies, whilst at the same time maintaining the resistance to thermal degradation achievable with existing leached PCD cutters. This is primarily to be achieved by restricting the application of the leaching process to areas of the PCD cutting elements where heat is known to be generated through use of the cutting elements in the cutting operation. In particular, by eliminating leaching from areas of the cutting elements where there is little or no contact between the cutting element and the material being cut, the toughness and impact strength of the PCD cutting element as a whole can be improved.

Furthermore, by appropriately designing the leaching profile at the areas where cutting and wear is known to take place, the leaching profile can be adapted to accommodate a greater degree of wear, so as to allow the cutting element to be used for longer periods in effectively cutting through material, thereby dramatically increasing the drilling performance of drill bits incorporating the cutting element. Drill bits containing cutting elements of this character are able to drill continuously for longer periods of time, and for further distances, before the cutting elements become blunted and the drill bit has to be tripped out and exchanged. Cutting elements formed in, this manner are also more resistant to cracking or fracture and so are less susceptible to failure during a drilling operation, improving the reliability of a drill bit incorporating the cutting elements.

Referring to FIG. 1, there is shown a fixed blade rotary drill bit 1 having multiple cutter blades 5 arranged to extend substantially radially from a central longitudinal axis of the drill bit. Each of the cutting blades is provided with a plurality of polycrystalline diamond (PCD) cutting elements 10, mounted to face in the direction of rotation of the cutting blades 5 in operation. As is known in the art, the PCD cutting elements 10 may be mounted to have a rake angle, this being the angle at which the face 22 of the cutting element 10 approaches the material of the formation to be cut, as the cutting blade 5 on which the cutting element 10 is mounted rotates in operation of the drill bit 1. Cutting elements on a drill bit can generally be described as being "front raked" or "back raked". A front raked cutting element tends to dig into the formation material being cut, which can increase the rate of penetration of the drill bit, but at the same time will likely increase the cutting resistance, which may stall the drill bit in use. A back raked cutting element has a tendency to ride or slip over the surface of the formation material being cut, this being the opposite effect to a front raked cutter. The result is a lower rate of penetration, but with less cutting resistance and risk of stalling the drill bit. In many cases, a mixture of positive, front raked cutting elements and negative, back raked cutting elements may be optimal in order to achieve a balance between the risk of the drill bit stalling and the desired rate of penetration of the drill bit into the formation. At the same time, the skilled person will appreciate that the rake angle of the cutting element as it is mounted on the cutting blade 5 of a fixed blade rotary drill bit 1 will alter the wear profile for the cutting element 10, as well as the point on the cutting face 22 of the cutting element 10 at which heat is generated during the use of the cutting element 10.

Figure 2:
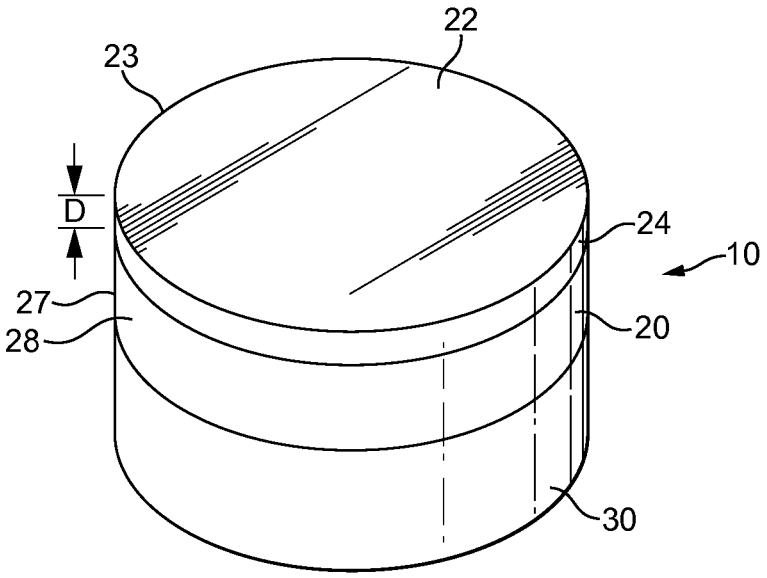
FIG. 2 is a three-dimensional perspective view of a PCD cutting element.
Figure 3:
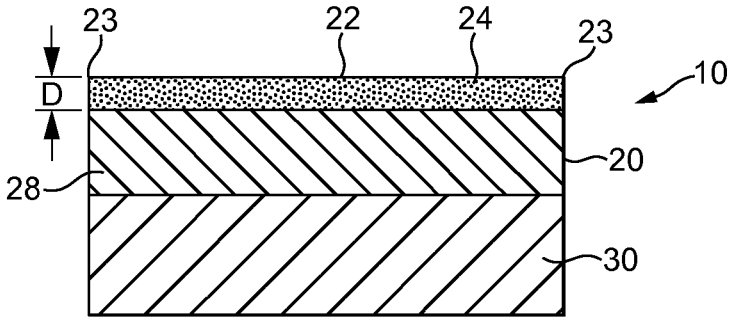
FIG. 3 is a cross-sectional view through the PCD cutting element of FIG. 2.
Figure 4:
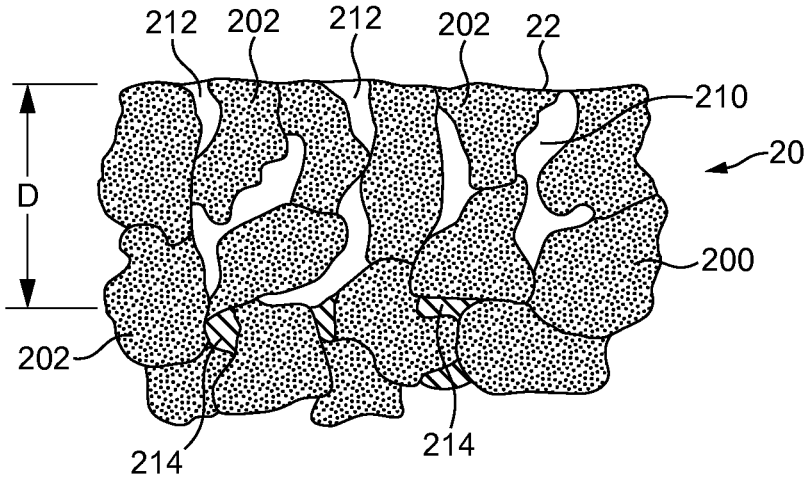
FIG. 4 is a schematic illustration of a leached portion at the surface of a PCD body, representatively illustrating the crystalline microstructure.

Turning to FIGS. 2 to 4, the basic construction of a PCD cutting element 10 is shown. The PCD cutting element 10 has a PCD body 20, attached integrally or otherwise bonded to a substrate 30, as discussed above. The PCD body 20 substantially consists of a matrix 200 of intercrystalline bonded diamond crystals or particles 202 which define, in between the crystals, interstitial spaces 212 which are substantially interconnected so as to provide an interstitial matrix 210. The interstitial matrix 210 is filled, during formation of the PCD body 20 in an HPHT process, with the binder-catalyzing material 214 which promotes the formation of the intercrystalline bonds.

The crystal microstructure of the PCD body is illustrated schematically in FIG. 4, in which the intercrystalline bonded diamond matrix 200 can be seen to be formed from a plurality of diamond crystals 202 which are bonded together by intercrystalline bonds. Interstitial spaces 212 are visible between the crystals 202, and are substantially interconnected to define the interstitial matrix 210 which extends essentially throughout the diamond matrix 200. On initial formation of the PCD body 20, substantially all of the interstices 212 contain the binder-catalysing material 214 therein. A leaching process is then applied to remove the binder-catalyzing material 214 to a desired depth, shown in FIGS. 2, 3 and 4 as the distance D measured from the leached surface 22 of the PCD body 20. It will be noted that, as shown in FIG. 4, the interface between the leached portion 24 and the unleached portion 28 of the PCD body is not flat and smooth. Therefore, an average depth should be taken in order to determine the depth D in any area of substantially similar leached depth.

In the example shown in FIGS. 2 and 3, the PCD body 20 is substantially cylindrical, being circular in cross-section and having a working surface 22 which is substantially perpendicular to the longitudinal axis of the cylinder. In other cylindrical PCD bodies, the working surface 22 may not be perpendicular to the longitudinal axis of the body, but may be at an angle thereto.

As seen in FIGS. 2 and 3, the PCD body 20 has been leached from the working surface 22 to a substantially constant depth D, so as to create a leached portion 24. Below this depth D, there remains an unleached portion 28, in which the binder-catalyzing material 214 remains, contained in the continuous interstitial matrix 210 formed by the interstities 212 of the intercrystalline bonded diamond matrix 200. As discussed above, the presence of the binder-catalyzing material 214 in at least a portion of the end of the PCD body 20 opposed to the cutting surface 22 is desirable, in order to securely bond the PCD body 20 to the substrate 30 on which it is mounted. It should be noted that, in many cases, a leached area on the top of working surface 22 is likely to have a substantially constant leached depth D. However, leaching on the side of PCD body 20 is likely to be tapered as the leached portion extends downwardly along the side surface of PCD body 20 from the top surface toward the boundary, also referred to as the interface, between the substrate 30 and the PCD body 20.

Figure 5:
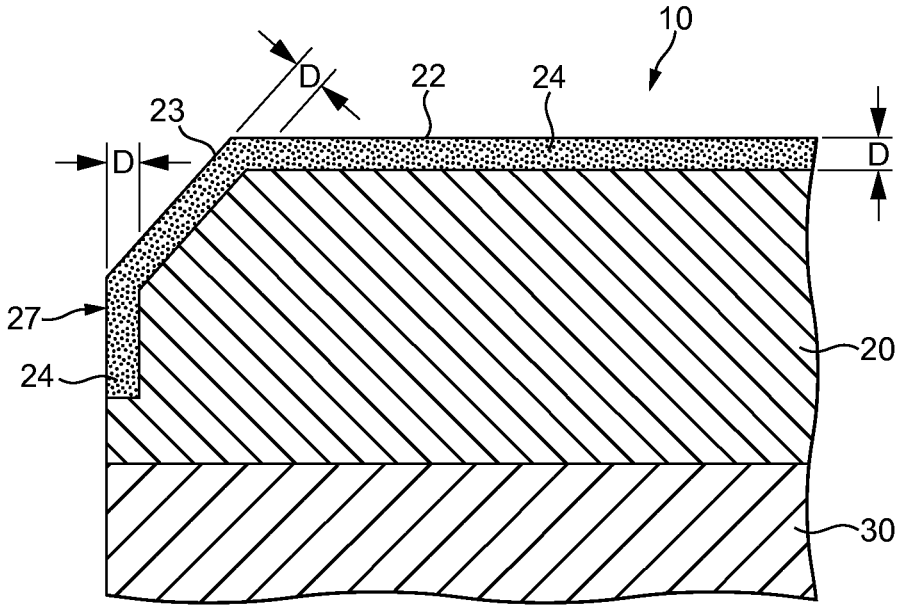
FIG. 5 is a schematic cross-sectional view through a PCD cutting element having a chamfered edge, illustratively showing leaching of the PCD body to a substantially uniform depth at the cutting face, cutting edge and side wall of the PCD body.

Turning to FIG. 5, an example is schematically illustrated in which the edge 23 of the PCD body 20 of FIGS. 2 and 3 has been chamfered, prior to applying the leaching process. The leaching process has then been applied not only to the cutting surface 22 but also to the chamfered edge 23 and a portion of the side wall 27 of the cylindrical PCD cutting element 20. In this connection, note that it is important that the leaching process does not extend to the substrate 30, as depleting the binder-catalyzing material 214 in this portion of the PCD body 20 would reduce the integrity of the bond between the substrate 30 and the PCD body 20, which may lead to the PCD body separating from the substrate 30 during use of the PCD cutting element 10.

In known leaching processes, the PCD cutting element 10 is essentially submerged in a bath of leaching acid, i.e. in an etching process, which serves to deplete the binder-catalyzing material 214 from the surface regions of the PCD cutting element. The depth to which depletion of the binder-catalyzing material 214 is achieved is substantially dependent on both the strength and type of acid being used and the length of time for which the leaching process is carried out.

In order to prevent unwanted areas of the PCD cutting element 10 from being leached by the acid, a masking material 40 is applied to those areas of the PCD cutting element where leaching is to be prevented. However, since applying the masking material 40 is a time-consuming, labour-intensive and, at least partially, manual task, existing commercial processes tend to simply mask sidewall areas of the PCD cutting elements according to a simple and substantially uniform masking pattern.

Figure 6A:
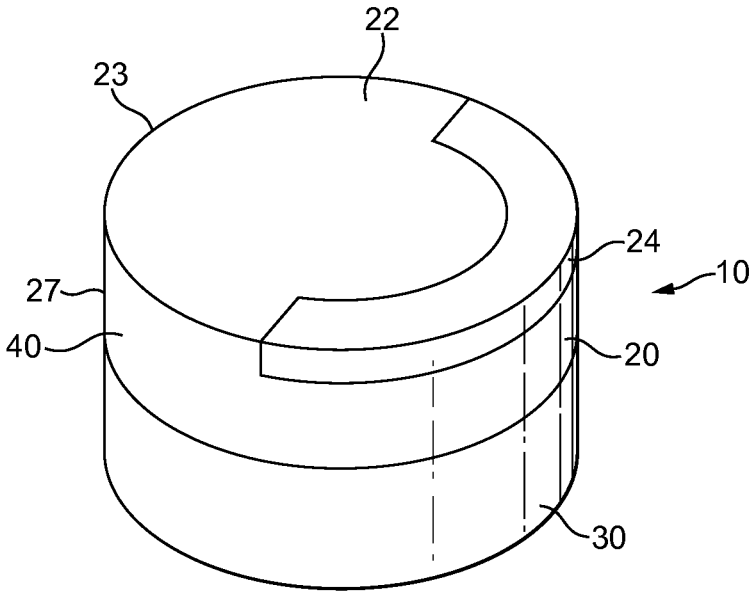
FIGS. 6A and 6B show three-dimensional perspective and cross-sectional views, respectively, of an embodiment of a PCD cutting element according to the present invention.
Figure 6B:
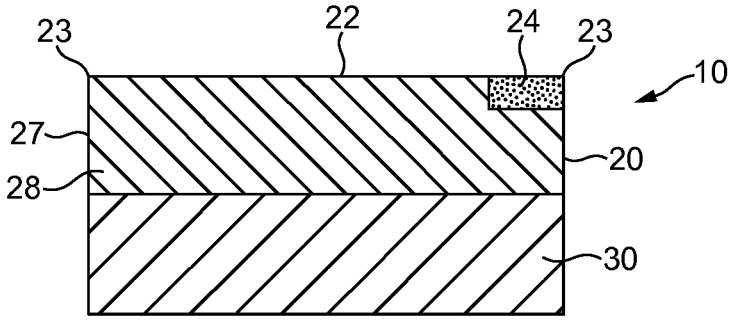

Turning to FIGS. 6A and 6B, an embodiment of the present invention is shown which attempts to improve on existing techniques. In this embodiment, the PDC cutting element 10 is masked so as to cover substantially all of the PCD body 20 and the substrate 30, including substantial portions of the cutting surface 22, except for in the region of an identified cutting area which encompasses a portion of the edge 23 between the cutting surface 22 and the sidewall 27 of the PCD cutting element. Accordingly, when the PCD cutting element 10 is etched in an acid bath to perform leaching, the binder-catalyzing material 214 is only removed from the portion of the edge 23 which is left exposed from the masking material 40. As such, substantially all of the PCD body 20 remains as an unleached portion 28, with only the exposed cutting area including the edge portion becoming a leached portion 24.

In this way, a significant proportion of the cutting surface 22, and the PCD body 20 as a whole, remains unleached, increasing the impact resistance of the PCD cutting body 20.

Additionally, it is believed that the leached portion 24 will have a higher impact resistance than leached surfaces of an equivalent depth in prior art PCD cutting elements, as the unleached portions of the PCD cutting body 20 serve to add structural strength, toughness and integrity to the smaller leached portion 24.

It should be noted that the masking pattern shown in FIG. 6A is only exemplary, in order to explain the concept of the masking and selective-leaching technique described above. In order to identify the appropriate area of the PCD body 20 to be leached, the portion of the PCD cutting element 10 which will contact and interface with the formation material being cut has to be identified. However, such area is readily determined by the skilled person, once the position of the PCD cutting element 10 on the blade 5 of the fixed blade rotary drill bit 1 is know, together with the rake angle for that cutting element 10. An appropriate area to be leached can then be selected, and a corresponding masking pattern can be applied to the PCD cutting element 10 before it is leached.

In this connection, it is noted that for fixed blade rotary drill bits 1, such as shown in FIG. 1 of the present application, PCD cutting elements 10 all are mounted with the major circular faces 22 of the PCD bodies 20 facing substantially in the direction of travel of the cutting blade 5 during operation. As such, the end face 22 of the cutting elements 10 is designated as the cutting face, and in most cases the cutting action takes place on this face 22, at the edge of this face 23, and on a portion of the side wall 27 of the PCD body 20 extending from the front cutting face 22.

Once the area of impact and frictional contact of the cutting element 10 with the formation material being cut is known, the temperatures likely to be generated at the surface of the cutting element 10 in use of the drill bit 1 can be determined, and the extent and depth of the portion 24 to be leached can be calculated.

The designer of such a selectively leached cutting element 10 has the option to tailor the leaching pattern to a single mounting position of the cutter 10 on the drill bit 1, in which case a different leaching pattern may, in principle, be provided for each cutter location of the drill bit 1 and a specifically tailored PCD cutting element 10 produced for each cutter position of the drill bit 1. Alternatively, the designer may select a more robust design, in which the leached area 24 is not entirely minimised for a single position of the cutting element 10 on the drill bit 1, but is expanded so as to be robust and suited to use at different cutter positions, although with the leached portion 24 of the PCD cutting element 10 suitably rotated to be orientated into a cutting orientation when mounted in any of the respective cutting positions on the drill bit 1. In either case, the leaching profile determined for the PCD cutting element 10 may be adjusted according to the rake angle at which the PCD cutting element 10 may be used, and the associated wear pattern experienced by the PCD cutting element 10 in operation, as discussed further below.

Figure 7A:
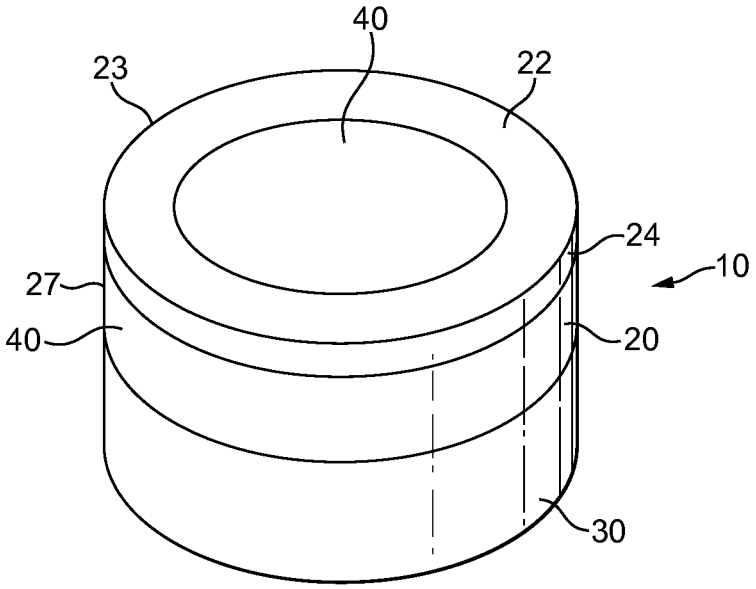
FIGS. 7A and 7B show three-dimensional perspective and cross-sectional views, respectively, of an embodiment of a PCD cutting element according to the present invention.
Figure 7B:
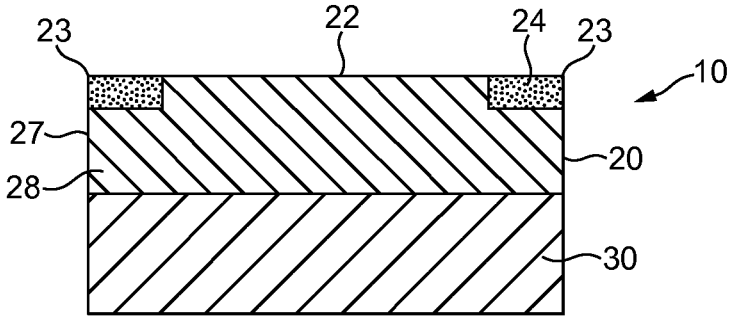

Turning to FIGS. 7A and 7B, a similar embodiment is disclosed, in which substantially all of the edge 23 of the PCD cutting element 10 is selectively leached, but substantial portions of the center of the cutting face 22 are left unleached. This leaves a leached portion 24 which extends around the circumference of the cutting face 22. As such, this cutting element will be orientation independent, as regards its rotational position about the longitudinal axis, when mounted onto a drill bit, such as the fixed blade rotary drill bit of FIG. 1. This can simplify the manufacturing process, and avoid any errors which may arise from incorrectly aligning/orienting the PCD cutting element 10 when mounting it to the drill bit 1.

As another way to avoid orientation errors when mounting the PCD cutting elements 10 disclosed herein, which is applicable to any of the embodiments of the present invention, an alignment mark or suitable alignment feature may be provided on the PCD cutting element, for example at a position on, or at various position around, the circumference of the substrate 30, in order to indicate the orientation of the leached cutting portion(s) 24 of the PCD body 20 when mounting the PCD cutting element 10 a drill bit. Suitable alignment features may, in fact, prevent mounting of the PCD cutting element 10 at an incorrect orientation, for example by providing a groove on the cutting element 10 and an inter-engaging ridge or notch projecting in the socket of the drill bit, such that the PCD cutting element 10 may only be installed in the socket at the correct orientation by engaging the ridge in the groove. In other cases, a simple mark, such as a line, a colored dot or an alphanumeric character, for example, may provide a visual indicator by which the person installing the PCD cutting element 10 into the socket of the drill bit 1 can correctly orient the cutting element 10.

It is additionally contemplated that, in the embodiment of FIGS. 7*a* and 7*b*, due to the leached portion 24 extending entirely around the circumference of the CPD cutting element 10, the structural integrity of the PCD cutting element as a whole can be improved, as the element may be able to obtain a more uniform distribution of forces, including those which may be experienced within the intercrystalline matrix of the PCD body 20.

It is also noted that, once one edge portion 24 of the PCD cutting element of FIG. 7A has become worn through use, the cutting element 10 can be rotated so as to bring an unworn portion of the leached cutting edge 23 into the cutting position on the drill bit 1, thus allowing the same PCD cutting element 10 to be re-used even after the cutting edge 23 has become worn in the original orientation of the cutting element mounted onto the drill bit 1.

FIGS. 8A and 8B and FIGS. 9A and 9B show, respectively, equivalent designs of a PCD cutting element 10 to those of the embodiments of FIGS. 6A and 6A and of FIGS. 7A and 7B, except in these embodiments the PCD cutting elements 10 are provided with a chamfered edge 23 between the cutting face 22 and the sidewall 27 of the PCD body 20.

As mentioned above, for PCD cutting elements 10 used in fixed blade rotary drill bits with the cutting face 22 facing substantially in the direction of rotation of the blade 5 of the drill bit 1 to which the cutting element 10 is mounted, the face 22 may be designated as the cutting face yet a substantial portion of the cutting action may be achieved at the edge 23. Nevertheless, as far as the terminology in the present specification is concerned, the cutting face 22 is taken to be the end face 22 of the PCD cutting element 10, and the chamfered edge is merely designated as an edge 23.

The chamfered edge 23 can provide improved structural integrity and impact resistance at the edge of the cutting face 22, thus improving the robustness of the PCD cutting element 10 and its resistance to brittle fracture. In particular, the generation of stress concentrations at the edge corner is mitigated.

Figure 8A:
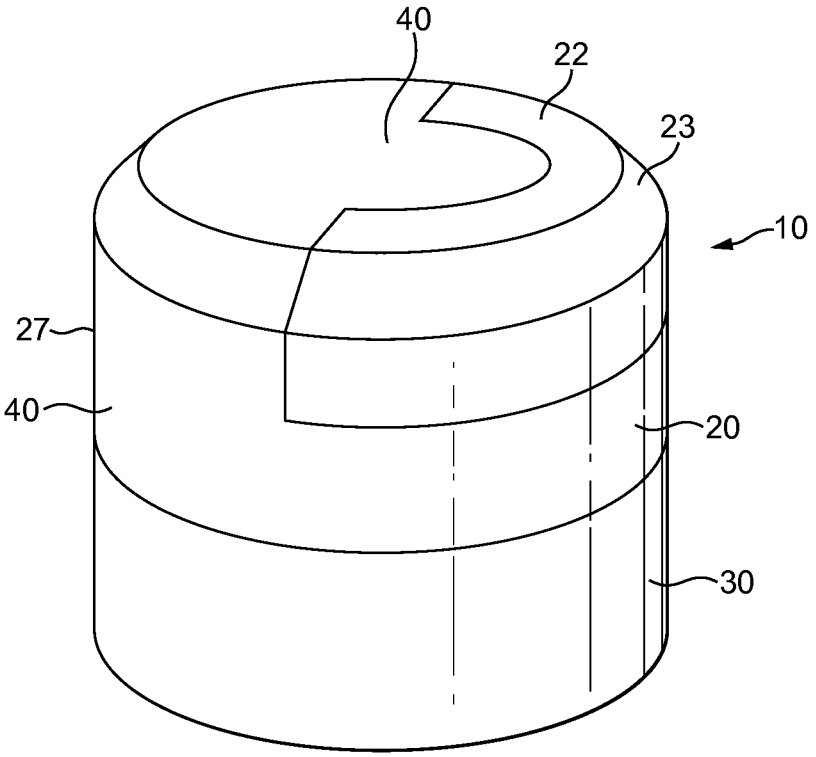
FIGS. 8A and 8B show three-dimensional perspective and cross-sectional views, respectively, of an embodiment of a PCD cutting element according to the present invention.
Figure 8B:
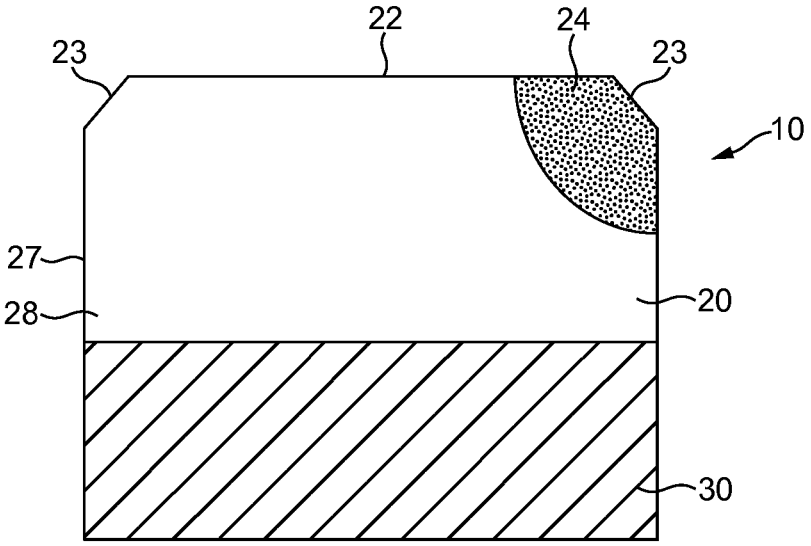
Figure 9A:
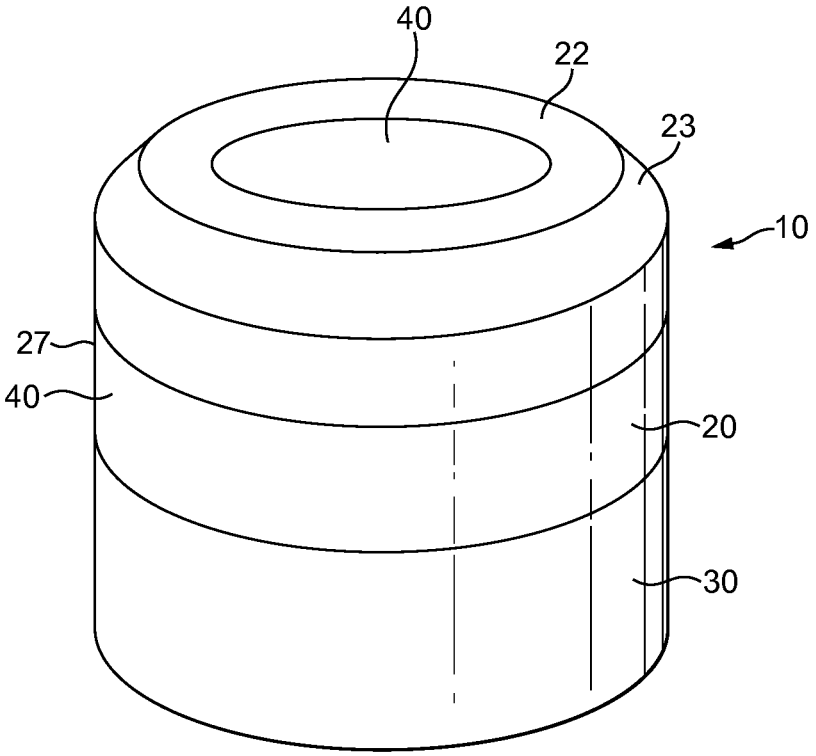
FIGS. 9A and 9B show three-dimensional perspective and cross-sectional views, respectively, of an embodiment of a PCD cutting element according to the present invention.
Figure 9B:
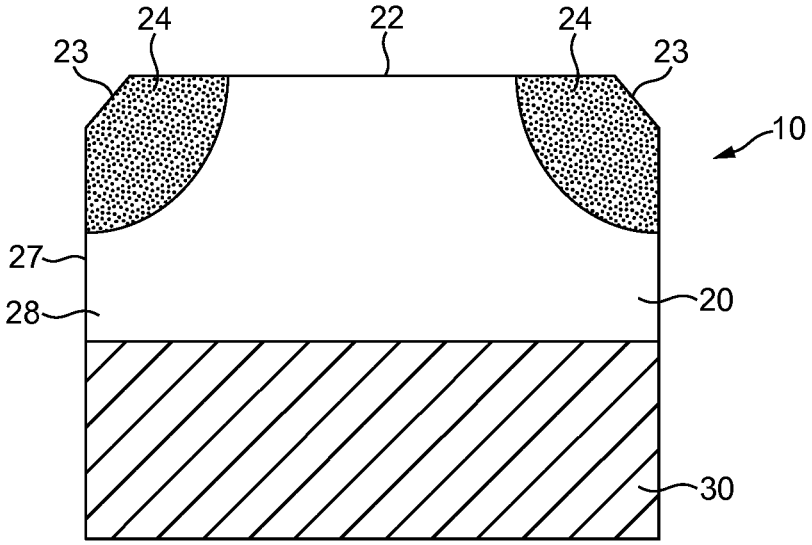

It will be appreciated that the size and extent of the chamfer applied to the edge 23 is exaggerated in FIGS. 8A, 8B, 9A and 9B, inter alia, and that the chamfering applied to the edge 23 may be less apparent in practice. Similarly, the size, shape and extent of the leached portion 24 shown in FIGS. 8B and 9B is purely exemplary and to assist the reader's understanding.

Figure 10A:
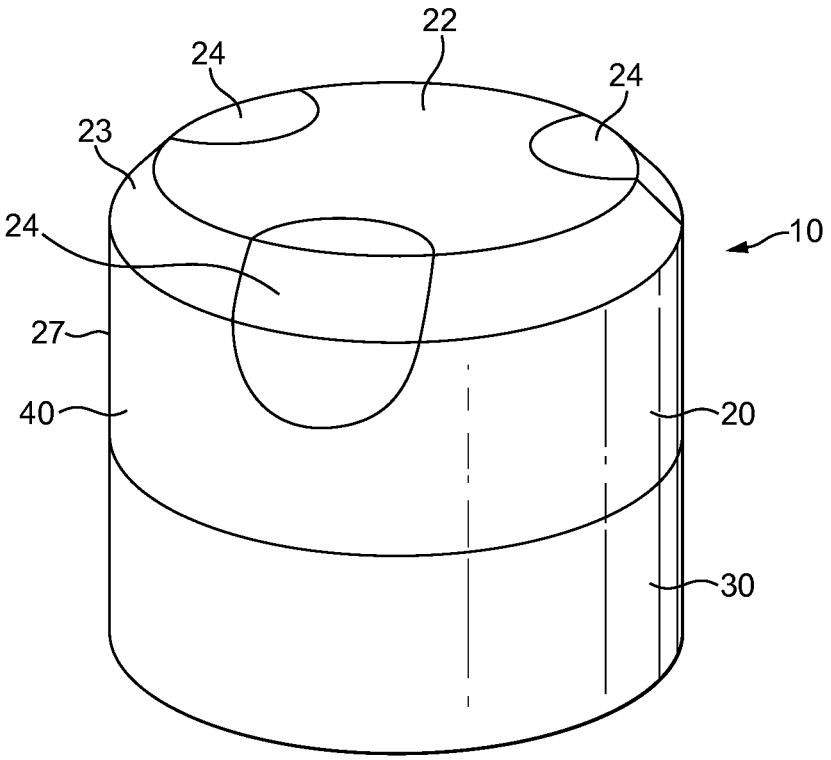
FIGS. 10A and 10B show three-dimensional perspective and cross-sectional views, respectively, of an embodiment of a PCD cutting element according to the present invention.
Figure 10B:
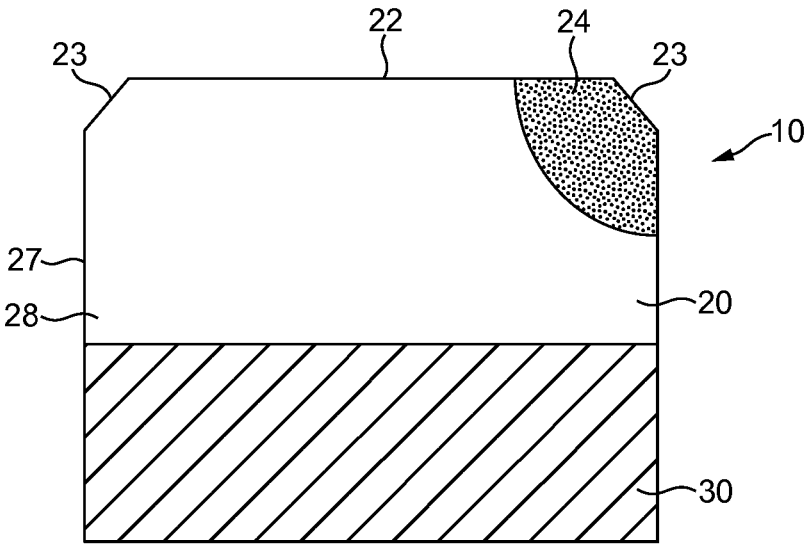

Turning to FIGS. 10A and 10B an embodiment in shown in which the edge 23 of the PCD body 20 is again chamfered. In this embodiment, as is clear from FIG. 10A, cutting areas are defined at three areas around the circumference of the cutting face 22, each cutting area encompassing a portion of the cutting face 22, the cutting edge 23 and the sidewall 27 of the PCD body 20. In the illustrated embodiment, the cutting areas are left exposed whilst the remainder of the PCD cutting element 10 is masked by a masking material 40. When the cutting element shown in FIG. 10A is then leached, a leached portion 24 will be obtained at each of the exposed cutting areas, as shown in FIG. 10B.

In the embodiment of FIGS. 10A and 10B, the cutting areas, i.e., leached areas 24, are disposed angularly about the longitudinal axis of the PCD cutting element 10, with rotational symmetry. In this way, the PCD cutting element 10 of FIGS. 10A and 10B has three designated cutting areas which can be independently brought into a cutting orientation when the PCD cutting element 10 is mounted in the socket of the drill bit 1 in which it will be used, so as to place only one of the cutting areas at a time in a position to contact with and cut the formation to be drilled. After that cutting area 24 has been worn down by use of the drill bit 1, the PCD cutting element 20 is then dismounted from the drill bit 1, and rotated about the longitudinal axis so as to bring another one of the leached portions into the cutting orientation.

Figure 11A:
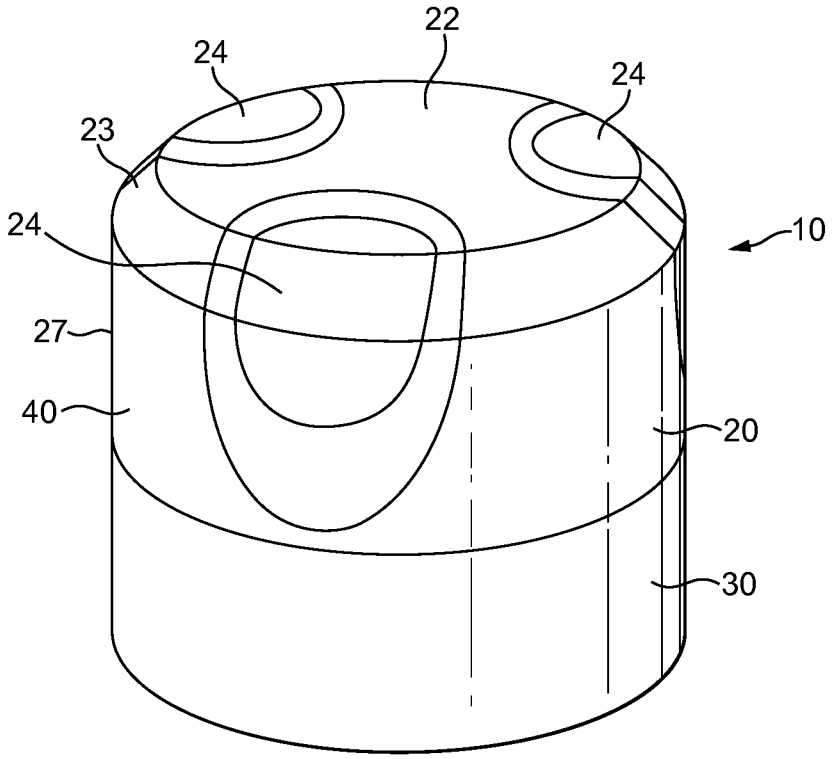
FIGS. 11A and 11B show three-dimensional perspective and cross-sectional views, respectively, of an embodiment of a PCD cutting element according to the present invention.
Figure 11B:
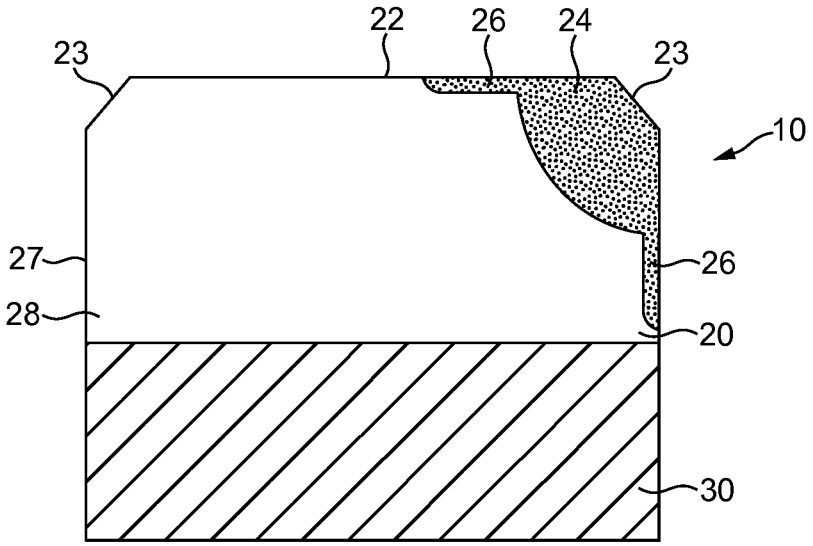

Turning to FIGS. 11A and 11B, a similar arrangement to that of FIGS. 10A and 10B is disclosed, with three angularly, rotationally-symmetrically disposed cutting areas being provided at separate positions around the circumference of the PCD cutting element 10.

In the embodiment of FIGS. 11A and 11B, however, an additional feature is also introduced. In addition to providing the leached cutting area 24, similar to that shown in FIGS. 10A and 10B, a further surrounding area of each of the cutting areas is also leached, indicated by the reference numeral 26 in FIGS. 11A and 11B.

As explained above, in order to obtain thermal stability in the PCD cutting elements, the leached area 24 must be made sufficiently deep so that heat generated by the cutting action as the cutting element 10 scrapes and gouges the formation being drilled during use of the drill bit 1 does not cause the temperature to exceed the degradation temperature for the PCD body 20 in the regions 28 of the polycrystalline bonded diamond matrix 200 which contain the binder-catalyzing material 214.

With the embodiment of FIGS. 10A and 10B, for example, this may necessitate leaching the PCD body 20 to a significant depth in the areas 24, in order to allow heat generated by the cutting action to be diffused and the temperature to be adequately reduced below the leaching depth D, in the regions where binder-catalyzing material 214 remains in the interstitial matrix 210.

However, with the embodiment of FIGS. 11A and 11B, by providing a relatively shallow leached area 26 surrounding the more deeply leached area 24 identified as the cutting area, the leaching depth D of the leached area 24 can be reduced. This is possible because the intercrystalline bonded diamond matrix 200 in the shallow leached area 26 has the same high thermal transport capacity as the diamond matrix in the deep leached area 24. As such, the shallow leached area 26 surrounding the deep leached area 24 serves to rapidly conduct heat away from the point of heat generation in the cutting area, thereby diffusing heat and reducing the temperature experienced in the deep leached portion 24. As a result, by this method, the deep leached portion 24 may be reduced in depth, as the degradation temperature will no longer be experienced so deeply at the cutting area due to the thermal diffusive effect of the shallow leached area 26.

An additional, coincidental benefit is that, as the cutting area is worn down by use of the PCD cutting element 10 to drill a subterranean formation, the erosion and wear of the leached portion 24 of the PCD cutting element 10 will merely bring a further leached portion of the PCD body 20 into contact with the formation, such that the desired wear resistance and hardness is maintained for a longer period of time, enabling the PCD cutting element 10 to continue to provide a cutting function even after substantial wear has occurred.

In this regard, it is also noted that, due to the relatively small surface area allocated for each of the cutting areas of the embodiments disclosed in the present specification, the deep leached portions 24 may necessarily have to be leached to a greater depth than was necessary for the uniformly leached cutters known in the past. This is not necessarily an entirely detrimental requirement, since, once again, the deeper leaching of the areas 24 means that a leached portion of the PCD cutting element remains in contact with the material being cut even after substantial wear. Furthermore, it is believed that, due to the deeply leached portion 24 extending into a non-leached portion 28 of the PCD body 20, the surrounding non leached portion 28 immediately adjacent to the deeply leached portion 24 helps to provide structural integrity and support; thereby maintaining the impact strength of the PCD cutting element, even when the deep leached area 24 is leached to a depth at which, in the prior art, brittle fracture or impact failure would have been expected to occur. By combining the deeply leached portion 24 of FIGS. 10A and 10B with a more shallow leached surrounding area 26 as shown in FIGS. 11A and 11B, the deep leached portion 24 of FIGS. 11A and 11B can also be reduced in depth, without compromising the thermal stability of the PCD cutting element 20, but still retaining the added strength due to non-leached portion 28 surrounding the deeper leached parts of deep leached portion 24.

In regard to both the embodiments of FIGS. 10A and 10B and of 11A and 11B, inter alia, the number of cutting areas is not restricted to three, and only one or two cutting areas, or more than three cutting areas, may be provided around the peripheral circumference of the PCD cutting element 10, as desired.

Turning to FIG. 12 and FIGS. 12A to 12D, there is shown a schematic representation of how a cutting element 10 can be worn in one cutting area 24, and then subsequently rotated so as to bring an unworn cutting area 24 into the cutting position.

Figure 12:
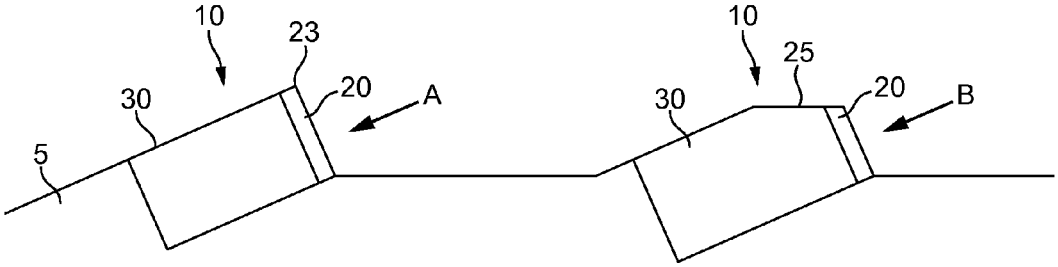
FIG. 12 shows, schematically, the wear pattern for a PCD cutting element mounted on a cutting blade of a fixed blade rotary drill bit, as seen in side view, whilst corresponding views are shown in FIGS. 12A and 12B, as seen in the directions, respectively, of the arrows A and B of FIG. 12.

FIG. 12 shows, on the left hand side, a schematic representation of a PCD cutting element 10 mounted in the socket on a blade 5 of a fixed blade rotary drill bit 1. The PCD body 20 is at the leading end in the direction of rotation of the fixed cutter blade 5, with the substrate 30 held in the socket. As the PCD cutting element 10 is used in a drilling operation, the edge 23 cuts into the formation with rotation of the drill bit 1. As shown schematically on the right hand side of FIG. 12, this results in wear and erosion of the cutting element, to reveal a worn cutting face 25.

Figure 12A:
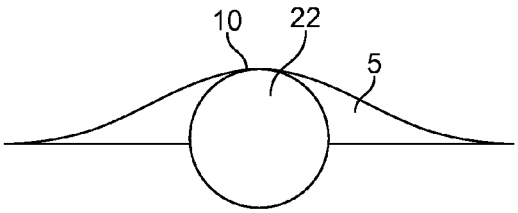
FIGS. 12C and 12D show how the PCD cutting element of FIGS. 12, 12A and 12B may be rotated in the socket of the cutting blade of the fixed blade rotary drill bit, in order to successfully bring different cutting areas of the PCD cutting element into the cutting position.
Figure 12B:
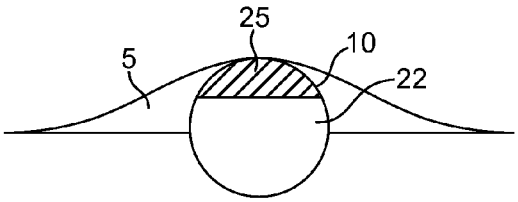

FIG. 12A shows the cutting element on the left hand side of FIG. 12, as seen in the direction of the arrow A, whilst FIG. 12B shows the cutting element on the right hand side of FIG. 12 as seen in the direction of arrow B.

Figure 12C:
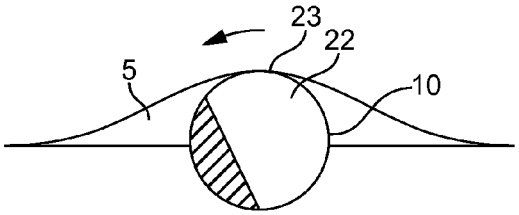
Figure 12D:
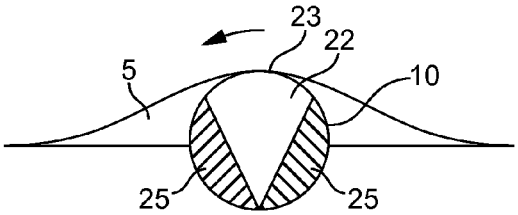

FIG. 12C shows how the worn cutting element of FIG. 12B may be rotated so as to bring another portion of the PCD body 20, in particular an unworn portion of the cutting edge 23, into the cutting position in the socket of the blade 5 of the fixed blade rotary drill bit 1. A further cutting operation is then assumed, prior to a subsequent further rotation, to bring a third unworn portion of the cutting edge 23 into the cutting position, as shown in FIG. 12D.

Referring back to FIGS. 11A and 11B, it will be appreciated that the two-depth leaching profile shown in FIG. 11B is merely one option, and that any number of separate leaching steps may be employed so as to obtain a desired leaching profile. Such a series of leaching steps requires the use of different masking patterns for each subsequent leaching step, with appropriate types of leaching acid and appropriate etching times being employed to achieve the desired depth of leaching at each step in the sequence. In this way, many suitable different leaching profiles can be obtained, and the leaching profile can be adapted specifically for the particular intended use of any given PCD cutting element 10.

In general, in the foregoing, and in the present specification throughout, leaching may be classified as deep leaching if the leached depth is greater than 100 microns, and as shallow leaching if the leached depth is less than 100 microns. It is contemplated that the leaching depth D for a uniform leaching profile would be of the order of about 100 to 500 microns. For embodiments having relatively deep-leached areas and relatively shallow-leached areas, it is contemplated that the leaching depth D in a shallow-leached area would be about 120 microns or less, but not less than 10 microns; and the leaching depth D in a deep-leached area would be 150 microns or more. As may be appropriate to the particular embodiment, the leaching depth in deep-leached areas may be 100 microns or more, 150 microns or more, 180 microns or more, or 200 microns or more, or 220 microns or more, but typically less than 500 microns. The leaching depth in shallow-leached areas may be 120 microns or less, 100 microns or less, 80 microns or less, or 50 microns or less. The leaching depth in shallow leached areas may be 10 microns or more, 20 microns or more, or 30 microns or more.

Figure 13A:
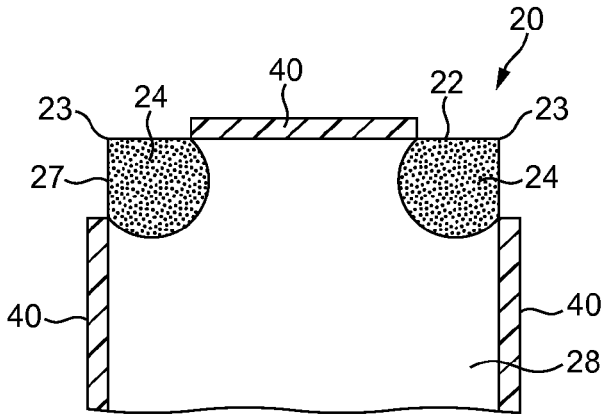
FIGS. 13A to 13C schematically show how successive masking and leaching steps may be performed, in an illustrative example, in order to obtain a desired leaching profile in a PDC cutting element.
Figure 13B:
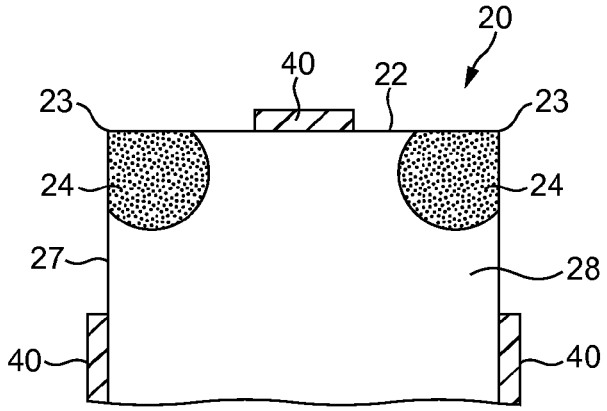
Figure 13C:
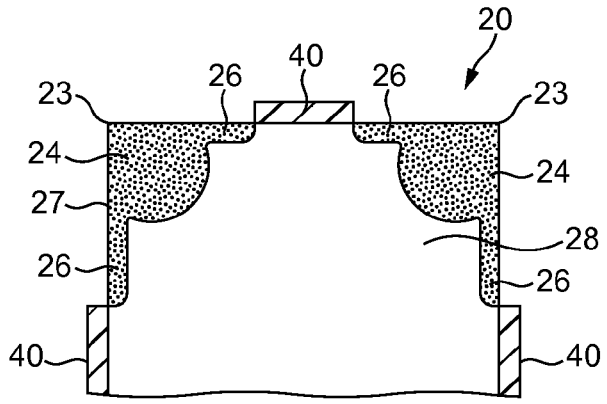

FIGS. 13A to 13C show one potential leaching process for obtaining a two-depth leaching pattern of the type shown in FIGS. 11A and 11B. In this process, a masking material 40 is applied to the PCD cutting element 10 in all areas except those where a deep leach is to be obtained. Etching is then performed to obtain a deep leached area 24 at the exposed portions of the cutting element 10. After this, the masking material 40 may be partially removed to expose further areas of the surface of the PCD body 20, or may be entirely removed and then replaced with new masking material 40 in a complete new masking pattern. Such a stage is shown in FIG. 13B. A further leaching process is then carried out, to a shallower leaching depth, to obtain surrounding shallow leached areas 26, as shown in FIG. 13C. Such a sequence might be employed to obtain a leaching pattern similar to the one shown in FIGS. 11A and 11B.

Figure 15A:
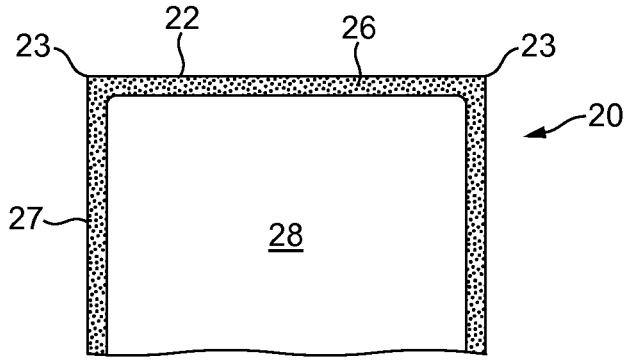
FIGS. 15A and 15B schematically show how successive masking and leaching steps may be performed, in an illustrative example, in order to obtain a desired leaching profile in a PDC cutting element.
Figure 15B:
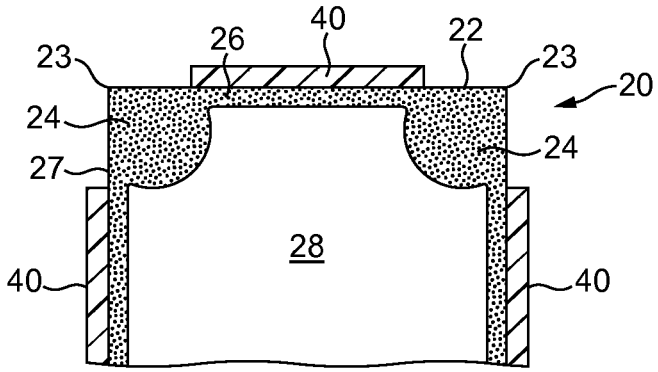

It is, additionally, contemplated that, in order to obtain the desired hardness and corrosion resistance at the extreme surfaces of the PCD body 20, a shallow leach would in many cases be desirable across substantially the entire surface of the PCD body 20. In the process of FIGS. 13A to 13C, this could be achieved simply by omitting the second masking step shown in FIG. 13B. As an alternative, the process of FIGS. 15A and 15B may be preferred, in which the shallow leach is first applied to substantially all of the PCD body 20, as shown in FIG. 15A. A masking pattern of masking material 40 is then applied, leaving exposed only the areas to be deep leached. As shown in FIG. 15B the PCD body 20 is then leached again to an increased depth, to provide the deep leached portions 24.

In general, it may be preferable to perform the leaching steps needed on the largest, surrounding areas 26 of the PCD body 20 first, as this obviates the need to remove the masking material 40 prior to a subsequent leaching step. This not only potentially reduces the labour involved in masking the relevant areas of the PCD body 20, but also ensures that there is no chance for unremoved masking material 40 to remain, for example, in interstices 212 of the diamond matrix 200, which could interfere with a subsequent leaching process in that area of the PCD body 20.

Figure 14A:
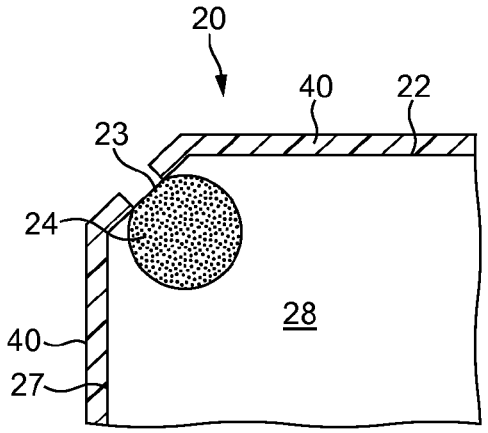
FIGS. 14A to 14D schematically show how successive masking and leaching steps may be performed, in an illustrative example, in order to obtain a desired leaching profile in a PDC cutting element.
Figure 14B:
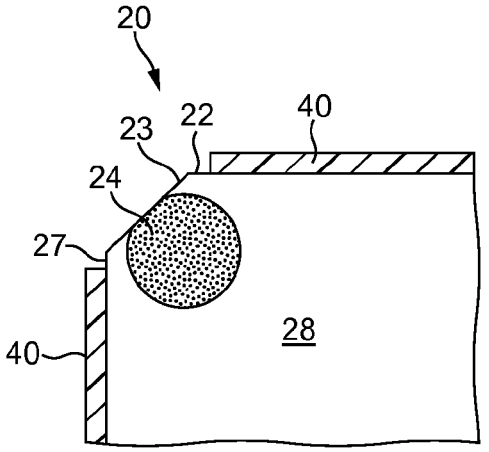
Figure 14C:
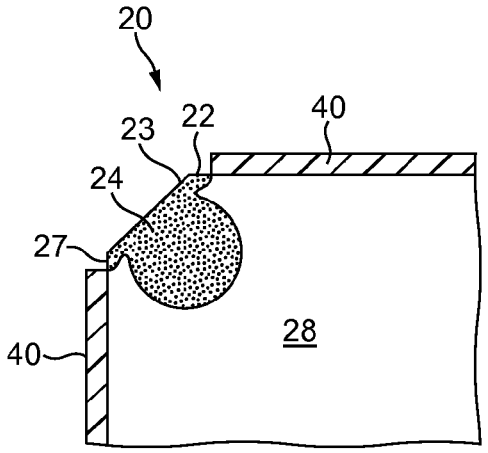
Figure 14D:
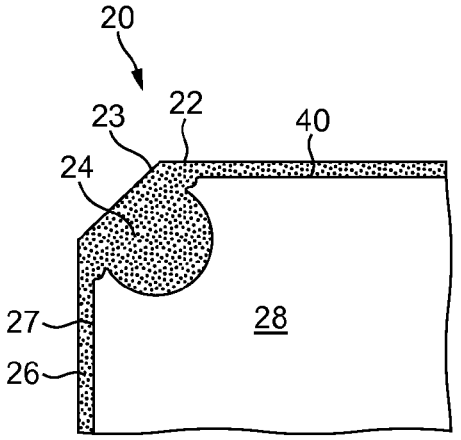

In the process shown in FIGS. 14A to 14D, another sequence of masking and leaching steps is described. In this case, the objective is to provide a leaching profile having three different depths. To this end, as shown in FIG. 14A, a small exposed area is left in the masking material 40 at the chamfered edge 23 of the PCD cutting element 20, and acid etching is performed to obtain a deep-leached portion 24. The masking material 40 is then either partially removed in a surrounding area, or entirely removed and a new masking pattern is applied exposing a larger are surrounding deep leached portion 24, as shown in FIG. 14B. Acid etching is then again performed to a reduced depth in the immediately surrounding area to obtain a staged-depth leaching profile in a region including a portion of edge 23, as shown in FIG. 14C. In a last step, shown in FIG. 14D, the remaining masking material 40 is removed and a final shallow leach is performed to provide a shallow leached portion 26 in remaining areas of the surface of PCD body 20.

Figure 16A:
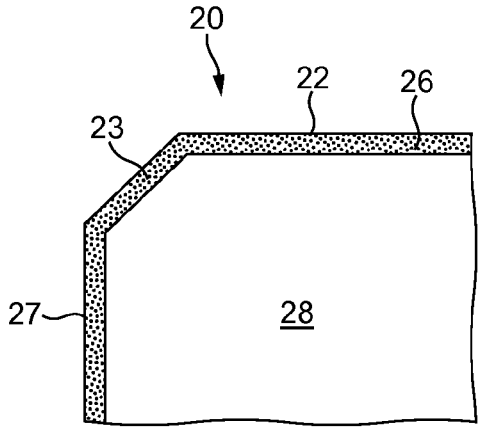
FIGS. 16A to 16C schematically show how successive masking and leaching steps may be performed in an illustrative example, in order to obtain a desired leaching profile in a PDC cutting element.
Figure 16B:
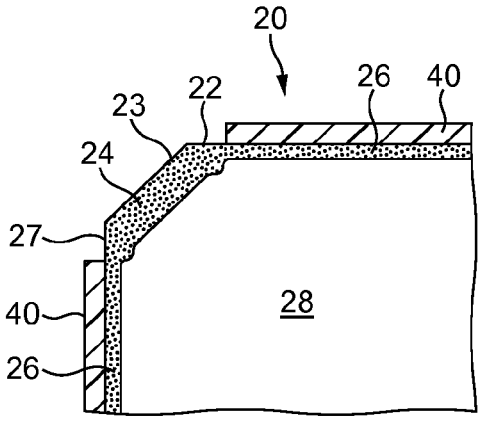
Figure 16C:
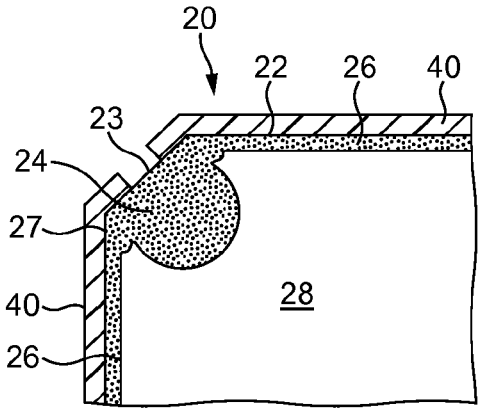

FIGS. 16A to 16C show an essentially reverse-order process in which, in FIG. 16A, a shallow leach is performed over substantially all, or major parts, of the exposed surface of PCD cutting element 20. Masking material 40 is then applied in a masking pattern excluding an area surrounding a portion of the cutting edge 23, and relatively deep leaching is then performed to an intermediate depth, as a first deep leach, to initiate the deep leached portion 24, as shown in FIG. 16B. The masking material 40 is then removed and a new masking pattern applied, or additional masking material is added to the original masking pattern, to leave only a small exposed area at the cutting edge 23. A final deep leaching step is then done to expand deep leached area 24 to the final desired depth.

It will be appreciated that, although the processes presented in FIGS. 14A to 14D and in FIGS. 16A to 16C ostensibly seek to implement the same leaching profile, the results obtained via each process may not be identical. For one thing, leaching is a diffusive chemical process, and the rate and direction of diffusion during etching may vary for a given masking pattern depending on whether or not there is binder-catalyzing material in the interstices immediately adjacent the surface being leached. Additionally, the different etching steps may use different types and/or concentrations of acid, and these may not give the same depth of leaching if simply used in reverse order.

Of course, more or fewer steps of masking and/or leaching may be performed according to the leaching profile sought to be obtained.

As briefly discussed above, the desired leaching profile may be determined based on a number of different considerations, for example depending on whether a very application-specific PCD cutting element is desired or one which is more robust and useful for installation at different cutting positions on the drill bit.

One factor to consider is the thermal profile resulting from heat generated at the surface of the PCD cutting element 10 during use in drilling a subterranean formation. This heat generation can be modelled, or measured, as a thermal event. The temperature profile resulting from that thermal event can then be determined, to identify the depth and extent to which temperatures at or exceeding the degradation temperature (the temperature at which thermal degradation of the PCD body takes place) is experienced. In one method for setting the leaching profile, the depth of the leaching profile may be set to substantially correspond to the depth of an isotherm of the temperature profile, such as the degradation temperature isotherm, at least in the region surrounding the point of heat generation at the surface. Of course, a safety margin may be allowed by incrementally increasing the leaching depth or by using an isotherm with a somewhat lower temperature than the degradation temperature.

Figure 17A:
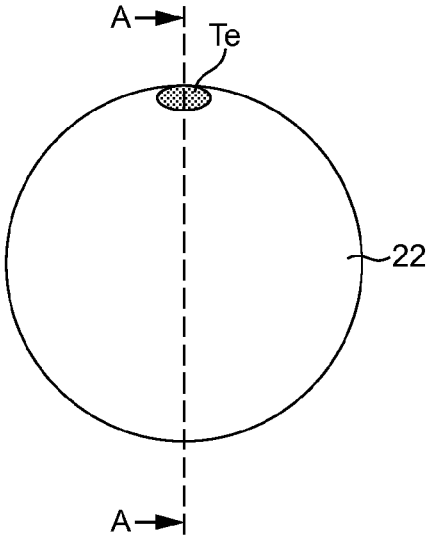
FIGS. 17A to 17C show one scheme for determining a desired leaching profile for a PCD cutting element.
Figure 17B:
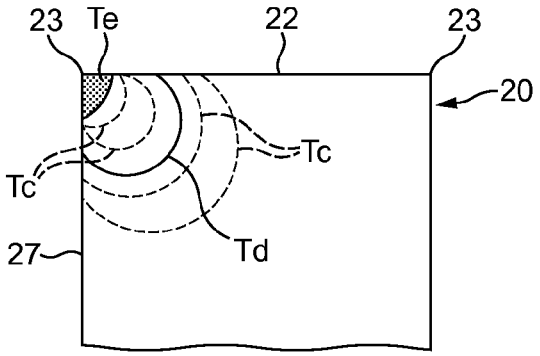
Figure 17C:
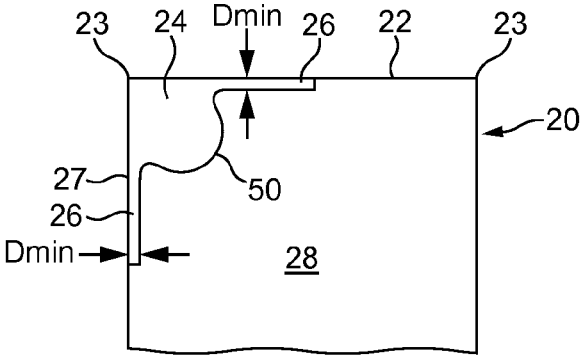

Referring to FIGS. 17A to 17C, a thermal event is modelled as generating an event temperature Te at a given area at the surface of the PCD body 20, as shown in FIG. 17A. The temperature profile is then measured (for example, using a thermal/infrared camera or using one or more thermocouples) or modelled by simulation based on known material properties of the PCD cutting element 10. FIG. 17B shows several isotherms Ti (shown in dashed lines) which define the temperature profile, but these are shown here by way only of illustration and the method does not require (although may include) plotting or visualising such isotherms. A solid line, Td, denotes the isotherm for the degradation temperature, showing how deep and wide that critical temperature penetrates. As shown in FIG. 17C, in this embodiment, the leaching profile 50 is then set to substantially correspond to the Td isotherm, allowing for error as appropriate, in the deep leached portion 24 of the leaching profile 50. In this example, a shallow leached portion 26 is also provided surrounding the deep leached portion, with a depth denoted as Dmin.

Figure 18A:
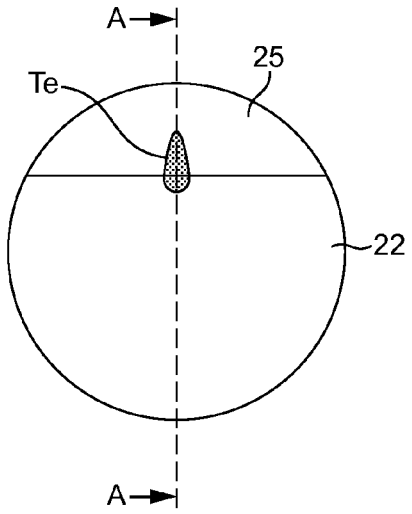
FIGS. 18A to 18C show one scheme for determining a desired leaching profile for a PCD cutting element.
Figure 18B:
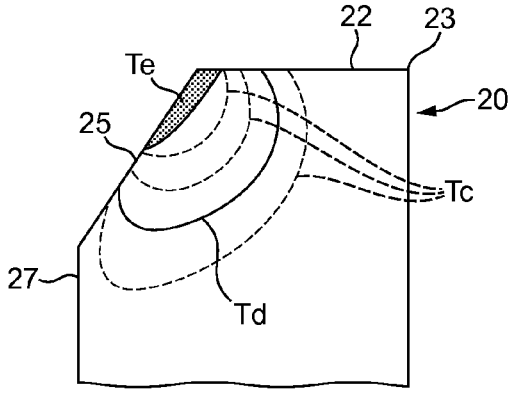
Figure 18C:
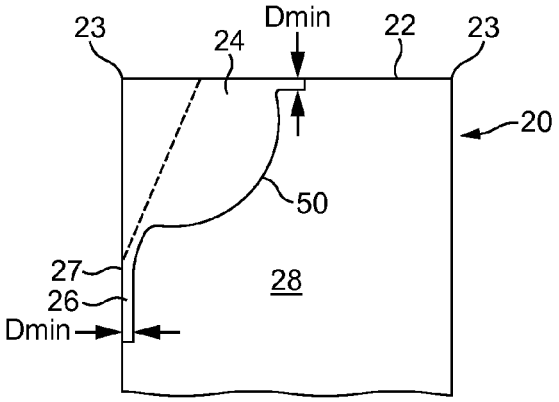

According to another similar method, account is also to be taken of the effect of wear during use of the PCD cutting element 10. Such a method is shown in FIGS. 18A to 18C, with steps that mirror those of FIGS. 17A to 17C, respectively. Here, account is taken of wear by modelling or measuring the thermal profile of the PCD cutting element when the cutting element 10 is in an assumed part-worn state, as seen in FIGS. 18A and 18B. The applied thermal event is again modelled as taking place for the part-worn condition of the PCD cutting element, as shown in FIG. 18B, which again shows several illustrative isotherms Ti and the degradation temperature isotherm Td. In FIG. 18C, the temperature profile of the part-worn cutting element is then applied to the unworn cutting element to define a desired leaching profile 50. In this example, again, the leaching depth of the profile 50 is set to the Td line of the part-worn PCD cutting element 10 in the region approximate the cutting edge 23 and/or the point of heat generation. A shallow leached surrounding area 26 of depth Dmin is again provided to aid in diffusing heat away from the temperature generation area.

The depth Dmin is typically set as a matter of judgement by the designer, but should be a minimum depth to allow the surface of the diamond matrix to effectively conduct heat laterally away from the point of heat generation and discharge that heat out of the PCD cutting element. This makes use of the beneficial thermal conductivity properties of the intercrystalline bonded diamond matrix.

Figure 19A:
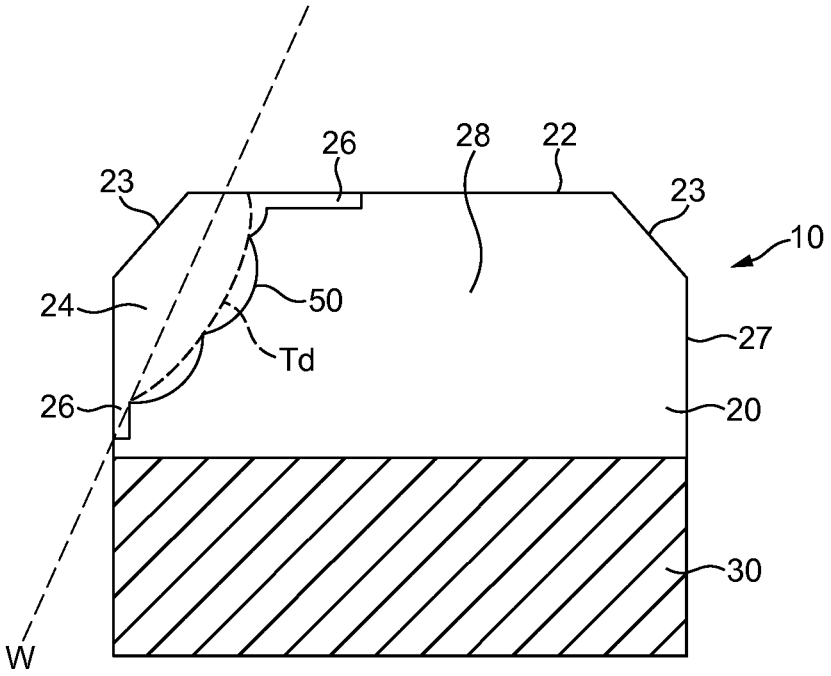
FIGS. 19A and 19B show, schematically, how the wear profile for a PCD cutting element may vary as the rake angle at which the cutting element is held in a drill bit is varied, and how the desired leaching profile may be determined in dependence thereon.
Figure 19B:
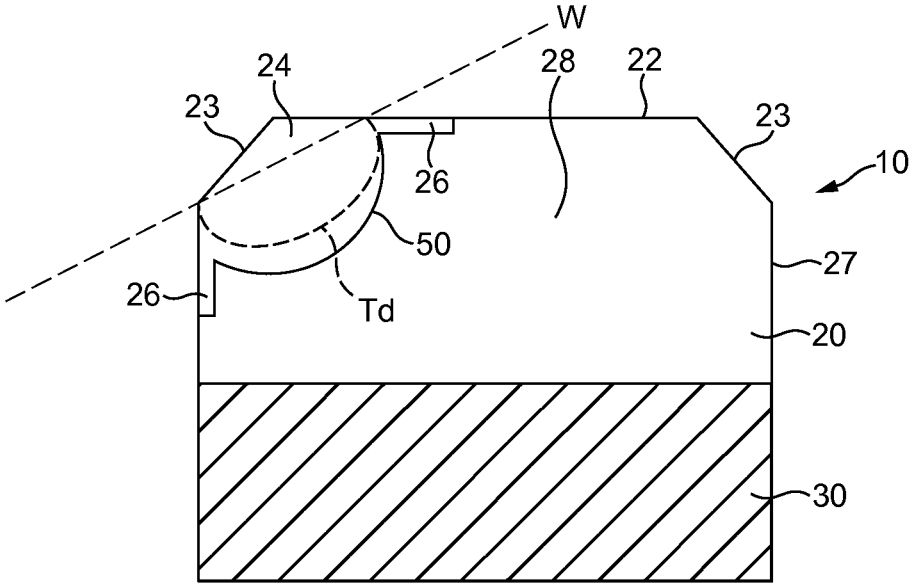

FIGS. 19A and 19B show schematically how the assumed wear profile for use in the method of FIGS. 18A to 18C can vary according to the rake angle of the PCD cutting element.

In FIGS. 19A and 19B, the thermal profile in the worn condition is simply indicated by the dashed Td line. A desired leaching profile 50 is then set to approximate the Td line, as before. Here, the leaching profile is illustrated as having been obtained by a limited number of steps in each case, and of course a leaching profile has to set that is feasible for manufacture and technically obtainable via existing leaching and/or related depletion processes. By taking account of the wear profile in the above manner, the PCD cutting elements remain thermally stable even after being part worn by use, so that the cutting life of the PCD cutting element can be extended.

Of course, PCD cutting elements designed in this way are then specifically configured for use at a given rake angle. A more robust design can be obtained by superimposing a series of overlapping leaching profiles, to accommodate wear at different rake angles.

Although the examples here show the wear, thermal and leaching profiles in two-dimensional form, three-dimensional profiles will normally be of greater interest. These may be computed using existing CAD programmes and modelling techniques, such as finite element analysis.

Indeed, it will be clear that the thermal materials properties of the PCD body change in dependence of whether binder-catalyzing material is contained within the interstices of the diamond matrix or not. Once an initial leaching profile has been specified, that profile can then be tested to see whether the thermal profile of a PCD cutting element exhibiting that leaching profile is substantially different from the thermal profile determined for the unleached PCD cutting element, and differences may be reduced by adjusting the leaching profile to move it closer to the Td line of modified thermal profile. If differences persist, an iterative optimisation routine may be run to converge to a design where the thermal profile and leaching profile agree.

The invention claimed is:

1. A method of manufacturing a polycrystalline diamond (PCD) cutting element comprising:

identifying a portion of a cutting surface of a PCD body in a PCD cutting element as a cutting area which, during use of the PCD cutting element, is heated by a cutting action of the cutting element;

leaching the PCD body to remove substantially all of a binder-catalyzing material from the cutting area to a first depth; and leaching the PCD body to remove substantially all of the binder-catalyzing material from at least a portion of the cutting surface surrounding the cutting area to a second depth, wherein the first depth is greater than the second depth, and wherein the PCD body is substantially cylindrical and no leaching occurs at a portion of the cutting surface central to a cylindrical axis of the PCD body.

2. The method of claim 1, wherein the portion of the cutting surface surrounding the cutting area is masked while leaching the cutting area to the first depth.

3. The method of claim 1, wherein leaching the cutting area to the first depth occurs prior to leaching the portion of the cutting surface surrounding the cutting area to the second depth.

4. The method of claim 1, comprising leaching substantially all of the cutting surface surrounding the cutting area to the second depth.

5. The method of claim 1, comprising leaching a side surface of the PCD body which extends from the cutting surface to a third depth.

6. The method of claim 1, wherein the PCD body is substantially cylindrical and the cutting surface is an end face of the cylinder, and wherein the cutting area includes at least a portion of a cutting edge that extends around the cutting surface, between the cutting surface and a side wall of the cylinder.

7. The method of claim 6, wherein the cutting edge is a chamfered edge between the cutting surface and the side wall.

8. The method of claim 6, wherein the cutting area includes substantially all of the cutting edge, which extends substantially entirely around the cutting surface.

9. The method of claim 1, wherein identifying the cutting area includes identifying multiple areas which independently during use of the PCD cutting element, are heated by the cutting action of the cutting element, depending on the orientation of the PCD cutting element during use.

10. The method of claim 9, wherein all of the multiple cutting areas are leached simultaneously to the first depth.

11. The method of claim 9, wherein two or more of the multiple cutting areas are disposed with rotational symmetry about an axis of the PCD body, such that the PCD body can be rotated about an axis after a first of the two or more of the multiple cutting areas has become worn down, so as to bring the first cutting area out of a cutting orientation and to bring another of the two or more of the multiple cutting areas into the cutting orientation.

12. The method of claim 1, wherein the cutting element includes one or more indicia to indicate a position of the cutting area.

13. The method of claim 1, comprising leaching to a third depth a transition region between the cutting area and the portion of the cutting surface leached to the second depth.

14. The method of claim 1, wherein the first depth is not less than about 0.15 mm.

15. The method of claim 1, wherein the second depth is not less than about 0.01 mm and not more than about 0.12 mm.

16. A polycrystalline diamond (PCD) cutting element comprising:

a PCD body comprising a cutting area and a cutting surface surrounding the cutting area, wherein the cutting area comprises substantially no binder-catalyzing material to a depth of not less than about 0.15 mm, and wherein at least a portion of the cutting surface surrounding the cutting area comprises substantially no binder-catalyzing material to a depth of not less than about 0.01 mm and not more than about 0.12 mm, and wherein the PCD body is substantially cylindrical with a binder-catalyzing material at a portion of the cutting surface central to a cylindrical axis of the PCD body.

17. The PCD cutting element of claim 16, wherein the second region at the surface of the diamond matrix includes at least a portion of a side surface of the PCD body, which side surface extends from the cutting face and meets the cutting face at the cutting edge.

18. An earth-boring drill bit comprising a diamond (PCD) cutting element comprising:

a bit body; and a PCD body inserted into the bit body and comprising a cutting area and a cutting surface surrounding the cutting area, wherein the cutting area comprises substantially no binder-catalyzing material to a depth of not less than about 0.15 mm, and wherein at least a portion of the cutting surface surrounding the cutting area comprises substantially no binder-catalyzing material to a depth of not less than about 0.01 mm and not more than about 0.12 mm, and wherein the PCD body is substantially cylindrical with a binder-catalyzing material at a portion of the cutting surface central to a cylindrical axis of the PCD body.

19. The earth-boring drill bit of claim 18, wherein the second region at the surface of the diamond matrix includes at least a portion of a side surface of the PCD body, which side surface extends from the cutting face and meets the cutting face at the cutting edge.

* * * * *